US012495891B1

(12) United States Patent
Frazier

(10) Patent No.: US 12,495,891 B1
(45) Date of Patent: Dec. 16, 2025

(54) HAIR STYLING TOOL AND METHOD OF USE

(71) Applicant: Nashara Frazier, Miramar, FL (US)

(72) Inventor: Nashara Frazier, Miramar, FL (US)

( * ) Notice: Subject to any disclaimer, the term of this patent is extended or adjusted under 35 U.S.C. 154(b) by 320 days.

(21) Appl. No.: 17/940,783

(22) Filed: Sep. 8, 2022

Related U.S. Application Data

(63) Continuation-in-part of application No. 16/359,320, filed on Mar. 20, 2019, now abandoned.

(60) Provisional application No. 62/646,488, filed on Mar. 22, 2018.

(51) Int. Cl.

| | |
|---|---|
| ***A46B 5/04*** | (2006.01) |
| ***A45D 24/02*** | (2006.01) |
| ***A46B 9/02*** | (2006.01) |
| *A45D 7/00* | (2006.01) |

(52) U.S. Cl.
CPC ..... *A46B 5/04* (2013.01); *A45D 24/02* (2013.01); *A46B 9/023* (2013.01); *A45D 2007/004* (2013.01); *A45D 2200/25* (2013.01); *A46B 2200/104* (2013.01)

(58) Field of Classification Search
CPC ... A46B 9/023; A45D 24/02; A45D 2007/004
USPC ..... 132/219, 149; 119/652, 664, 625
See application file for complete search history.

(56) References Cited

U.S. PATENT DOCUMENTS

| | | | | | |
|---|---|---|---|---|---|
| 1,200,596 | A | * | 10/1916 | Daly | A47L 13/18 2/21 |
| 1,343,713 | A | * | 6/1920 | Fuller | A46B 5/04 2/21 |
| 1,611,510 | A | * | 12/1926 | Brown | A46B 5/04 15/227 |
| 1,795,500 | A | * | 3/1931 | Omundson | A46B 5/04 132/142 |
| 1,847,401 | A | | 3/1932 | Richard | |
| 1,894,413 | A | * | 1/1933 | Nenning | A46B 5/04 15/104.94 |
| 2,016,951 | A | * | 10/1935 | Welker | A46B 5/04 401/196 |

(Continued)

OTHER PUBLICATIONS

Natural Hair Styling at Your Fingertips [online], retrieved on Jul. 9, 2020 (pp. 1-2—Home page) and pp. 3-4 also retrieved on Jul. 9, 2020 from https://thecoilbrush.com/products/the-coil-brush. Retrieved from the Internet: <URL: www.thecoilbrush.com.

(Continued)

*Primary Examiner* — Nicholas D Lucchesi
(74) *Attorney, Agent, or Firm* — Carol Green von Kaul, Esq.

(57) ABSTRACT

A hair styling finger tool that includes a flexible body with an elongated tubular member formed in the shape of a human finger, wherein the wherein the elongated tubular member is configured to slidably fit on an entirety of the human finger while leaving the rest of a user's hands uncovered; wherein the flexible body comprises a plurality of hair guiding elements disposed on the entirety of the elongated tubular member; and securing means positioned at a conical tip of the elongated tubular member. A method of styling hair is disclosed, including providing the hair styling finger tool for use on a finger, and using the hair styling finger tool to perform a hair styling method with a finger.

2 Claims, 34 Drawing Sheets

(56) References Cited

U.S. PATENT DOCUMENTS 2,018,903 A * 10/1935 Stevens ..... A46B 5/04 15/227
2,092,987 A * 9/1937 Remington ..... A46B 5/04 2/21
2,103,083 A * 12/1937 Lynch ..... A46B 1/00 601/139
2,526,128 A * 10/1950 Grant ..... A45D 24/14 132/148
2,686,325 A * 8/1954 Silver ..... A46B 5/04 401/7
3,043,295 A * 7/1962 Ward ..... A46B 1/00 15/187
3,368,668 A * 2/1968 Micciche ..... A46B 5/04 206/229
3,608,565 A 9/1971 Ensign
3,960,155 A 6/1976 Wall
4,026,307 A 5/1977 Morrow
4,038,996 A 8/1977 Eronini
4,308,860 A * 1/1982 Sanders ..... A61H 7/003 15/227
4,689,828 A 9/1987 Brewer
4,766,914 A * 8/1988 Briggs ..... A45D 20/00 132/212
4,994,061 A 2/1991 McPherson
5,240,517 A 8/1993 Matsumoto
5,249,589 A 10/1993 Moore
5,379,782 A 1/1995 Tabb
5,623,953 A 4/1997 McDowell
5,626,156 A 5/1997 Vicory, Sr.
5,669,398 A 9/1997 Dadgostar
5,682,837 A * 11/1997 Courtney ..... A46B 5/04 119/664
5,725,000 A 3/1998 Rice
5,765,252 A * 6/1998 Carr ..... A46B 5/04 15/104.94
5,873,376 A 2/1999 Howley
5,921,252 A 7/1999 Chubb
5,927,291 A 7/1999 Beall
6,109,214 A * 8/2000 Rampersad ..... A46B 5/04 401/7
6,189,150 B1 2/2001 Jones-Roberson
6,260,559 B1 7/2001 Schirren
6,305,387 B1 10/2001 Atchison
6,453,910 B1 9/2002 Lloyd
6,578,205 B1 * 6/2003 King ..... A41D 19/0055 600/38
6,609,524 B2 8/2003 Lloyd
6,656,139 B2 * 12/2003 Zwezdaryk ..... A61H 19/00 600/38
6,962,159 B1 11/2005 Adam
7,020,898 B1 4/2006 Pucci et al.
7,318,441 B1 1/2008 Clerie
7,346,955 B2 3/2008 de Laforcade
7,854,234 B2 12/2010 Maillefer
7,992,578 B2 8/2011 Tobias
8,132,571 B1 3/2012 Jackson
8,245,715 B1 * 8/2012 Davis ..... A45D 2/002 132/161
8,479,748 B1 * 7/2013 Satir ..... A45D 24/10 132/213.1
8,479,749 B2 7/2013 Randolph
8,505,550 B2 8/2013 Velazquez
8,955,525 B2 2/2015 Tiram
9,125,469 B2 9/2015 Longoria
9,138,039 B2 9/2015 Debenedictis
9,713,583 B1 7/2017 Pressly
10,258,134 B2 4/2019 Davis
10,441,009 B1 10/2019 Ivany
2002/0152538 A1 * 10/2002 McDevitt ..... A46B 5/04 2/163
2002/0166567 A1 11/2002 Potter
2003/0102006 A1 6/2003 Valentini
2003/0150469 A1 8/2003 Myers
2003/0188760 A1 10/2003 Ogunro
2003/0213497 A1 11/2003 Lexcen
2004/0003824 A1 1/2004 Habibi
2004/0025897 A1 2/2004 Menaged
2004/0045570 A1 3/2004 Yao
2004/0261810 A1 12/2004 Gifford
2005/0198855 A1 9/2005 Cafaro
2005/0268933 A1 12/2005 Kimata
2006/0090771 A1 5/2006 Ramet
2006/0218696 A1 10/2006 Billups
2006/0288954 A1 * 12/2006 Graunstadt ..... A01K 13/001 119/652
2007/0095361 A1 5/2007 Stachowski
2007/0151574 A1 7/2007 Orth
2007/0226874 A1 10/2007 Cain
2007/0283516 A1 * 12/2007 Rasmussen ..... A01K 13/001 15/160
2008/0072921 A1 3/2008 Habibi
2008/0283080 A1 11/2008 Habibi
2008/0283081 A1 11/2008 Habibi
2008/0313788 A1 * 12/2008 Yan ..... A46B 5/04 119/611
2008/0314404 A1 12/2008 Chan
2009/0145452 A1 6/2009 Anderson
2009/0194129 A1 8/2009 Junemann
2009/0255549 A1 10/2009 Smith
2009/0266379 A1 10/2009 Du
2010/0031970 A1 2/2010 Klovstad
2010/0269845 A1 10/2010 Tamme
2011/0056505 A1 * 3/2011 Parkinson ..... A46B 9/028 15/160
2011/0257474 A1 10/2011 Howard
2012/0227757 A1 9/2012 Fardoe
2013/0000655 A1 1/2013 Velazquez
2013/0000656 A1 1/2013 Velazquez
2013/0319445 A1 12/2013 Knight
2013/0319450 A1 12/2013 Ragosta
2014/0060563 A1 * 3/2014 Haynes ..... A46B 5/04 15/159.1
2014/0076349 A1 3/2014 Deng
2014/0076351 A1 3/2014 Debenedictis
2014/0083446 A1 3/2014 Julemont
2014/0222027 A1 8/2014 Lucido
2015/0068547 A9 3/2015 Hawkins
2015/0075552 A1 3/2015 Purkey
2015/0075553 A1 3/2015 Purkey
2015/0114425 A1 4/2015 Park
2016/0007707 A1 1/2016 Carter
2016/0058152 A1 3/2016 Purkey
2016/0100665 A1 4/2016 Fetman
2016/0120243 A1 5/2016 Matzel
2016/0135564 A1 5/2016 Bang
2016/0192757 A1 * 7/2016 Tapia ..... A45D 24/14 132/125
2016/0324289 A1 11/2016 Dixon
2016/0367002 A1 12/2016 Kraszewski
2017/0006989 A1 1/2017 Debenedictis
2017/0013928 A1 1/2017 Debenedictis
2017/0142931 A1 * 5/2017 Michaelson ..... A01K 13/002
2017/0273373 A1 9/2017 Lee
2017/0332762 A1 11/2017 Chee-Ping
2018/0199699 A1 7/2018 Quinn
2020/0170318 A1 6/2020 Davis
2021/0127635 A1 * 5/2021 Michaelson ..... A01K 13/002
2021/0196022 A1 * 7/2021 Boatman-Tate ..... A45D 24/14
2024/0008450 A1 * 1/2024 Baig ..... A46B 5/04

OTHER PUBLICATIONS

ChromaComb Demo, published Mar. 11, 2017, available at https://www.youtube.com/watch?v=uCJIdpVuMQA.

MakPets. Pet Grooming Brush Glove for Dogs & Cats, published Dec. 9, 2017, available at https://www.amazon.com/dp/B004CV4UV8/ref=asc_df_B004CV4UV85379116/?tag=hyprod-20&creative=395033&creativeASIN=B004CV4UV8&linkCode=df0&hvadid=198081271679&hvpos=104&hvnetw=g&hvrand=5302100815756397186&hvpone=&hvptwo=&hvqmt=&hvdev=c

(56) References Cited

OTHER PUBLICATIONS

&hvdvcmdl=&hvlocint=&hvlocphy=9011906&hvtargid=pla-377284325907.
Curl Hair Sponge Gloves Tutorial for Barbers Wave Black Twist Brush Styling Tool for Men and Women, published May 28, 2018, available at https://www.amazon.com/Tutorial-Barbers-Styling-Dreadlocks-Kasimedo/dp/B07CZL7CVK?th=1.
Swingline Rubber Finger Tips, Size 11 1/2, Medium, 12/Box (54035), published Aug. 6, 2010, available at https://www.amazon.com/Swingline-Rubber-Finger-Medium-54035/dp/B0017DF9U0.
Dr. Brown's Finger Toothbrush, published Feb. 2, 2018, available at https://www.amazon.com/Dr-Browns-HG010-Finger-Toothbrush/dp/B073XXCBHP/ref=sr_1_3?keywords=dr.+browns+finger+toothbrush&qid=1552940724&s=baby-products&sr=1-3-catcorr.
Healsmile® Electric Hot Compress Stroke Hemiplegia Finger Recovery Equipment Hand Training Electric Fingers Massager 110V-220V Infrared Therapy Finger Passive Training, published Sep. 28, 2016, available at https://www.amazon.com/Healsmile%C2%AE-Electric-Hemiplegia-Equipment-110V-220V/dp/B01CGK6J38?th=1.
Forgun Pet Dogs Cats Oral Dental Clean Teeth Care Hygiene Brush Soft Finger Toothbrush, published Nov. 9, 2018, available at https://www.amazon.com/Forgun-Dental-Hygiene-Finger-Toothbrush/dp/B07FBDSRYP.
Healthy Hair cleaning Washing brush Scalp Health Massager Glove Comb Healthy Hair cleaning Washing brush Scalp Health Massage, published at least as early as Dec. 10, 2018, available at https://www.dhgate.com/product/healthy-hair-cleaning-washing-brush-scalp/429988353.html.
Treatment Kit to Stop Finger Sucking by TGuard brand FingerGuard (Size Small: Ages 0-4), published at least as early as Feb. 6, 2016, available at https://www.amazon.com/Treatment-Finger-Sucking-TGuard-FingerGuard/dp/B000WHVMP8.
Hair Styling Ring (Brass, Small) for Hair Sectioning, Weaving, Balayage, Highlights & Braiding by ProCombs, published at least as early as Jun. 5, 2017, available at https://www.amazon.com/Sectioning-Balayage-Highlights-Braiding-ProCombs/dp/B06Y6KN71Z?th=1.
Latex Finger Cots 205 PCS Disposable Finger Caps Rubber Fingertips Protector as Finger Guards (205), published May 5, 2017, available at https://www.amazon.com/Finger-Disposable-Rubber-Fingertips-Protector/dp/B06XSB555H?th=1.
Stop Finger Sucking with Blue Attack Small Ages 2-4 Years Old, published Nov. 3, 2017, available at https://www.amazon.com/Finger-Sucking-Attack-Small-Years/dp/B004W0AVYY.
3-Point Products Gel Tubes for Fingers and Toes, (Package of 5), published Dec. 7, 2015, available at https://www.amazon.com/Point-Products-Gel-Tube-Ounce/dp/B006WCWIYG?th=1 https://www.amazon.com/3-Point-Products-Jammed-Fingers-Package/dp/B07CVPP1YN?th=1.
3-Point Products 3pp Buddy Loops for Jammed and Broken Fingers (1/2" wide (Pack of 5)), published at least as early as Jul. 16, 2014, available at https://www.amazon.com/3-Point-Products-Jammed-Fingers-Package/dp/B07CVPP1YN?th=1.

* cited by examiner

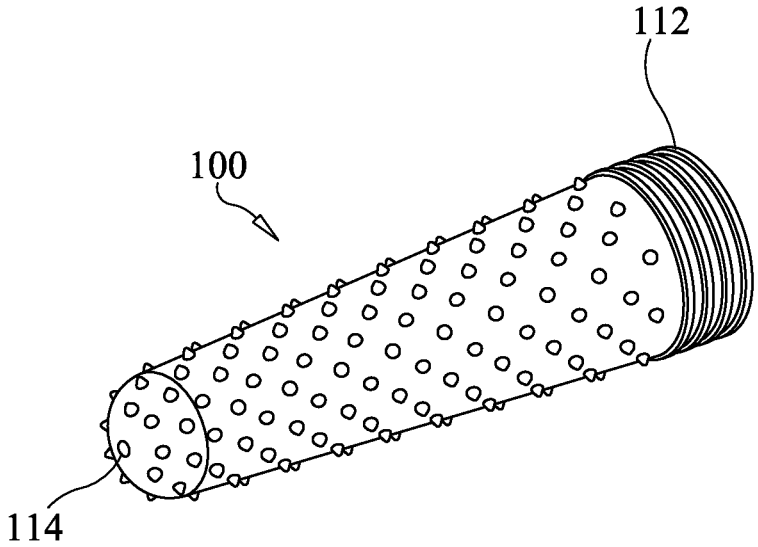
FIG. 2E (Detangling Device)
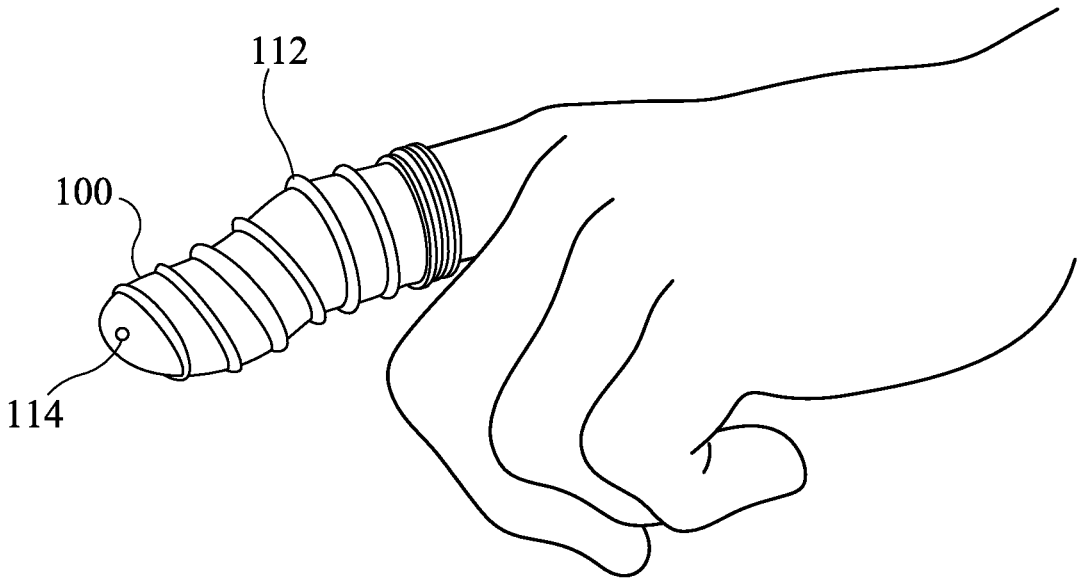
FIG. 2F (Curling Device)

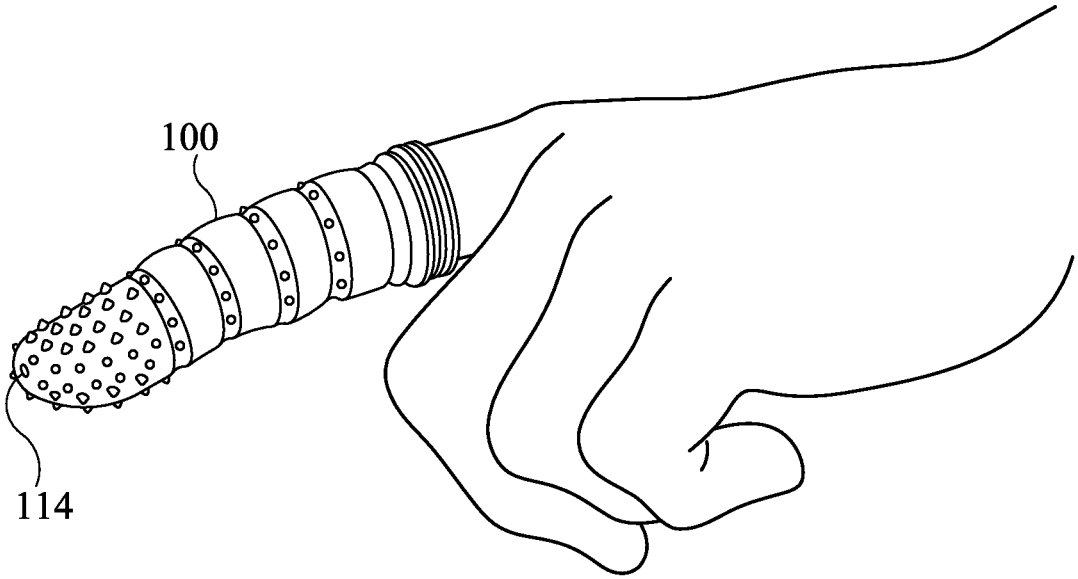
FIG. 2K
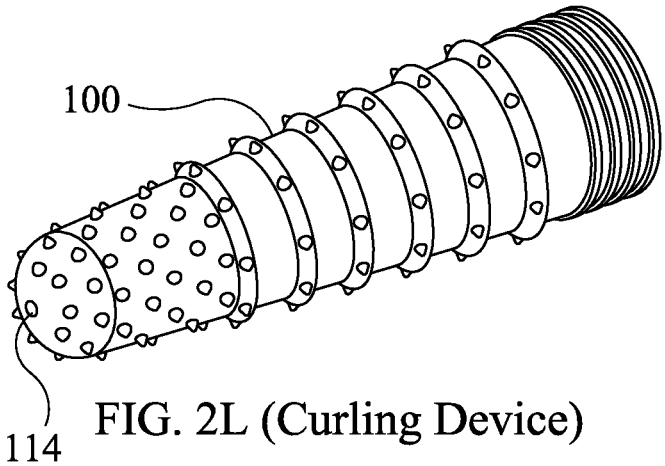
FIG. 2L (Curling Device)
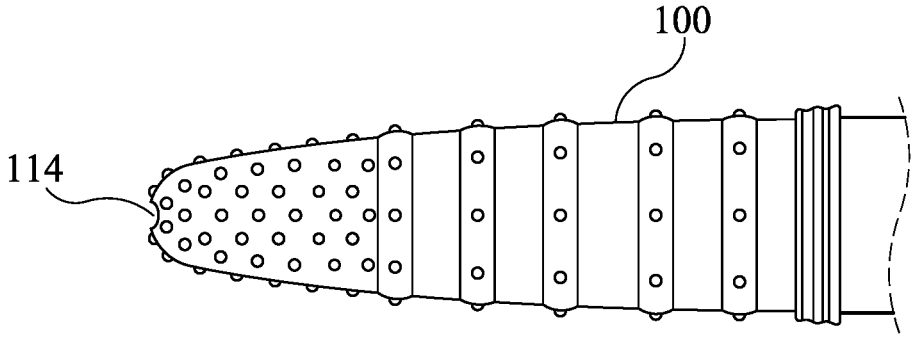
FIG. 2M

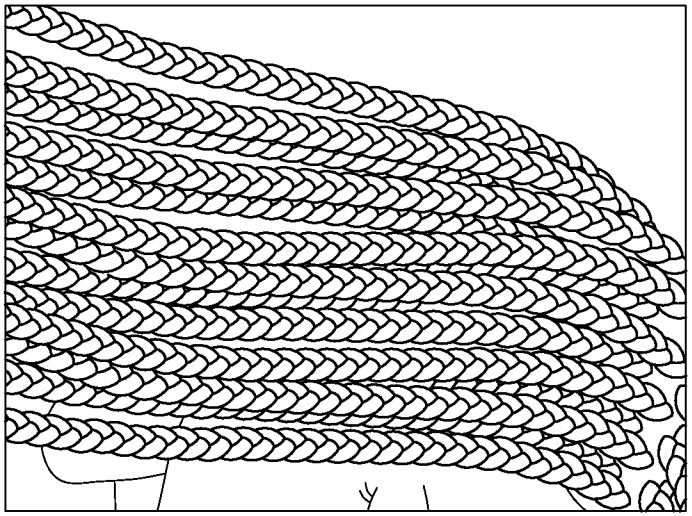
FIG. 8C (Braiding)
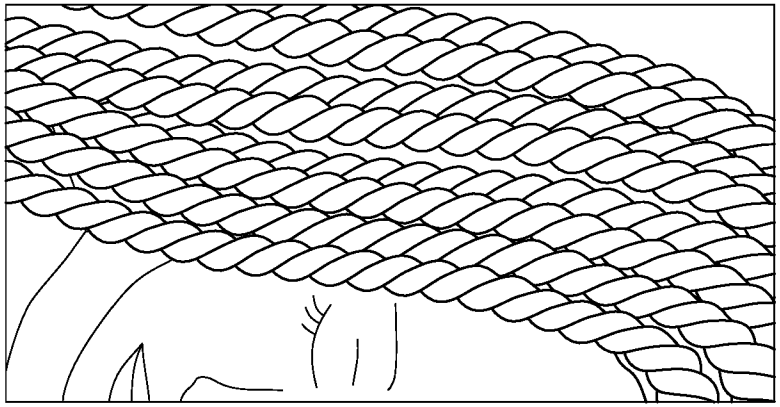
FIG. 8D (Twisting)

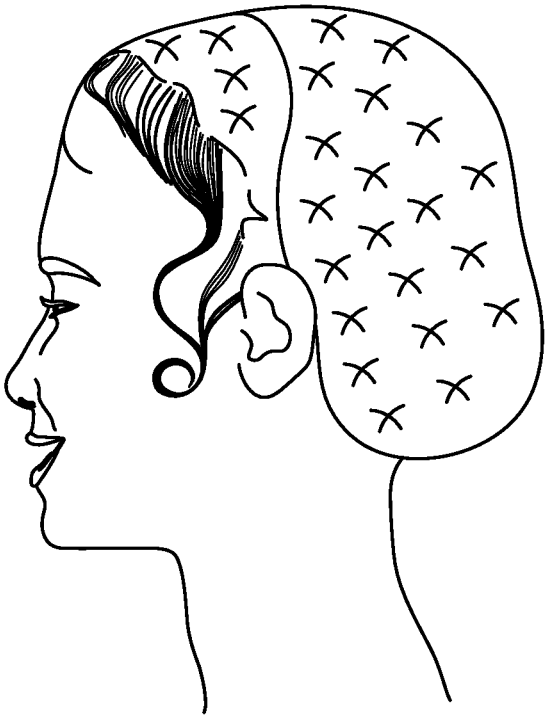
FIG. 9A (Hairline Styling)
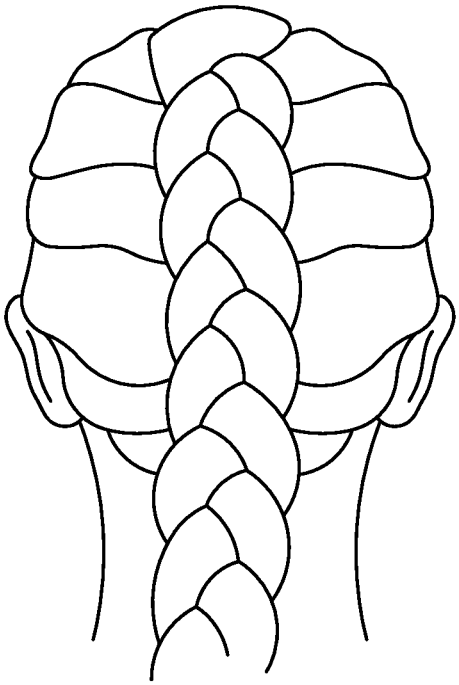
FIG. 9B (French Braid)

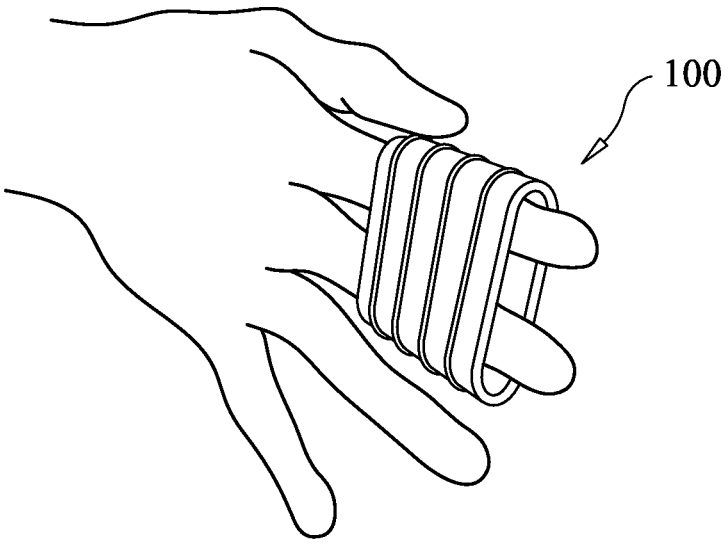
FIG. 10A (Shingling Device)
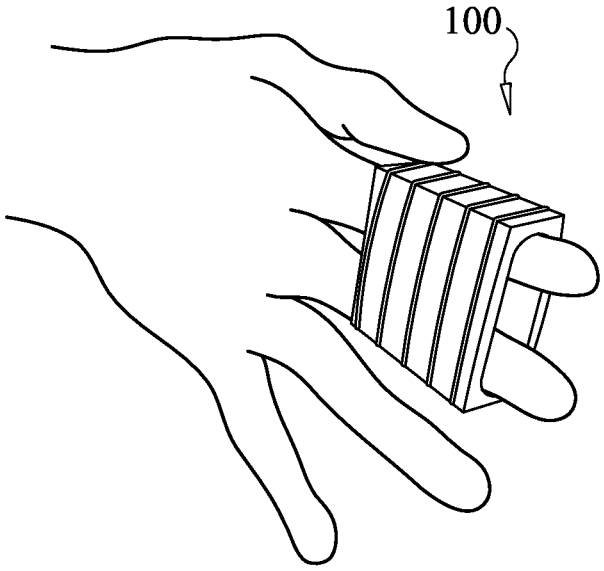
FIG. 10B

Clip for Shingling

HAIR STYLING TOOL AND METHOD OF USE

PRIORITY CLAIM

This application is a continuation-in-part application of U.S. Non-Provisional patent application Ser. No. 16/359,320 filed Mar. 20, 2019 titled "Hair Styling Finger Tool And Method Of Use," by inventor Nashara Frazier, which claimed priority under 35 U.S.C. § 119 to U.S. Provisional Patent Application No. 62/646,488, titled "Hair Styling Finger Tool And Method Of Use," by inventor Nashara Frazier, filed on Mar. 22, 2018, which is incorporated herein by reference and hereby claims priority thereof.

FIELD OF THE INVENTION

The following disclosure relates generally to human hair styling tools, and methods for using human hair styling tools to style hair, and more specifically, to hair styling tools designed to be fitted and worn on one or more fingers, while leaving the rest of a user's hands uncovered, and which are particularly suitable for use on Afro-textured naturally spirally curly/coily hair and/or naturally organized spirally curly hair, and related methods of use thereof.

BACKGROUND OF THE INVENTION

Humans have been styling hair for the millennia. Styling of hair may be considered an aspect of personal grooming, cosmetics, fashion, self-expression, and/or gender, cultural, or religious identity. Hair styling has usually involved a person using their bare hands to manipulate their hair, such as by braiding their hair. People have also used styling tools, such as brushes, combs, curling irons, blow dryers, scissors, clippers, razors, and the like, to style their hair. Such tools are gripped by a person using their entire hands, usually a person styling their own hair, or a hairdresser or barber styling the hair of another. In more recent history, individuals have applied chemicals to their hair to achieve certain styles, such as hair colorings, conditioners, lotions, oils, bleaches, and hair perming chemicals, such as ammonium thioglycolate, which works by breaking down the disulphide bonds in the hair follicle. Perming chemicals soften and expand the hair's keratin, allowing the hair to be more easily manipulated into the desired (straight or curly) style.

The problem with styling hair with bare hands is that it is not an effective aid for detangling. Bare hands provide low retention for curl formation and there is only one type of surface to manipulate hair, namely a person's skin, which can be painful for persons with sensitive skin because of the friction caused by pulling or manipulating the hair, heat, and chemicals, or fingernails being too sensitive or short to separate the hair into the desired style. Afro-textured, naturally curly, or coily hair has its own unique styling challenges as an individual may have a variety of different textures, curls and/or coils (smaller, tighter curls resulting in more defined ringlets) in different sections of the hair. For example, some hair strands may range from very tight and defined ringlets of small curls with zigzag patterned hair shaft, while other random sections of the hair may be looser, with more formed curls than coils resulting in a multi-textured hair, requiring varying technique for the different curl patterns to obtain a uniform style.

While existing tools have solved some of these problems, such as more effective detangling by brushes, they present their own set of problems including: being inflexible, providing only temporary style retention (in the case of brushes and combs), being obstructive and bulky, and inefficient, causing users to have pick-up and lay down the tools every time they perform a styling method and prevent users from using the full dexterity of their hands.

For example, once a user has completed a step of detangling using a brush or comb, user typically rests the brush or comb and continue with styling. During styling with one's bare hand however, hair can become entangled again requiring the user to have to stop the process to pick up the brush or comb and detangle the hair once more. Some users will also use bare hands to separate hair creating a part. The resulting part is usually not uniform or in a straight line and may be less than the desired style.

Yet another issue with using only hands or existing tools (specialized brushes, combs, styling gels, conditioners, etc.) to style hair, is that it takes a very long time to complete a desired hairstyle relative to the invention disclosed herein. For example, some of the hair styling methods disclosed herein can take upwards of several hours, or 25% to 50% longer to complete with only hands and/or existing tools.

BRIEF SUMMARY

The various embodiments disclosed herein result from the realization that hair styling may be achieved more quickly, efficiently, and effectively by providing the hair styling finger tool and method of use thereof, as described herein and shown in the drawings. This tool and related method of use provides the following results, and more, when compared to existing hair styling tools: reduces the amount of time to complete a hairstyle by 25% to 50%, provides for longer style retention in the hair, meaning that hairstyles last longer, and user fatigue is reduced since users no longer must lay down and pick-up tools as they style hair. The tool is unlike a glove, which covers the entire hand having separate parts for the thumb and each of the 5 fingers. Similarly, the tool is different from a mitten, which covers the entire hand with a separate part for the thumb and second part for all four fingers combined. Instead, the hair styling finger tool may be worn on one or more finger(s), while leaving the rest of a user's hands (e.g., palm and/or back of the hand) uncovered.

BRIEF DESCRIPTION OF THE DRAWINGS

FIGS. 8A-8D each shows the result of a method for using a hair styling finger tool in accordance with one or more embodiments.

FIGS. 9A-9B each shows the result of a method for using a hair styling finger tool in accordance with one or more embodiments.

FIGS. 10A-10G each shows a hair styling tool in accordance with one or more embodiments.

DETAILED DESCRIPTION OF THE INVENTION

Figure 1A:
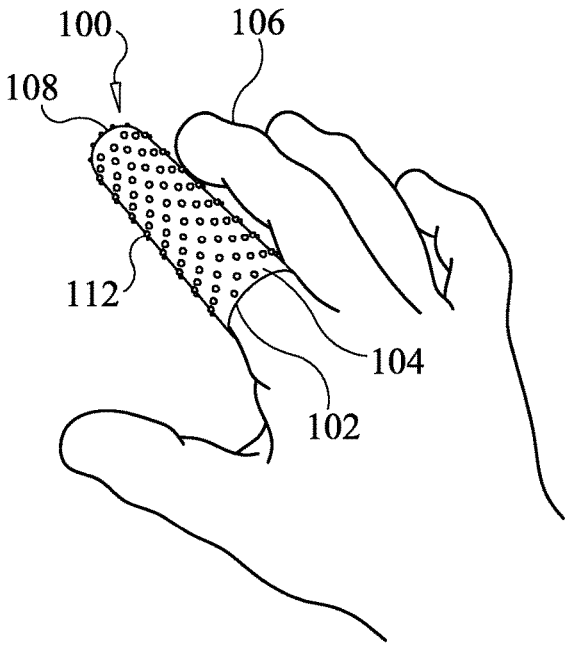
FIGS. 1A-1L each shows a hair styling finger tool in accordance with one or more embodiments.
Figure 1B:
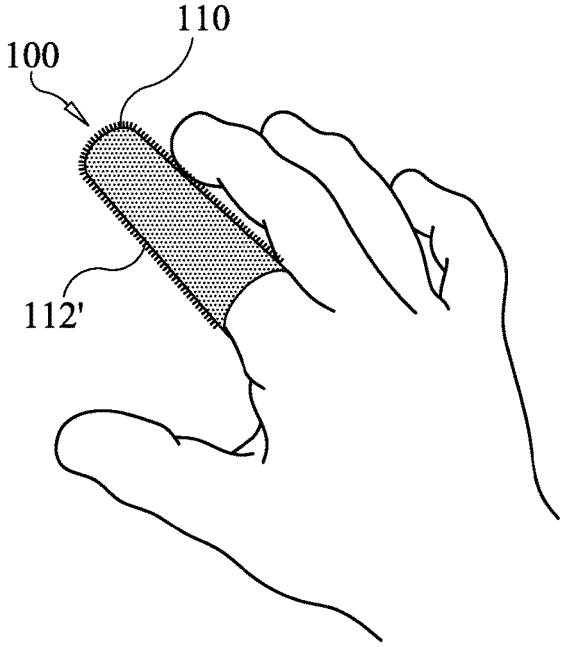
Figure 1C:
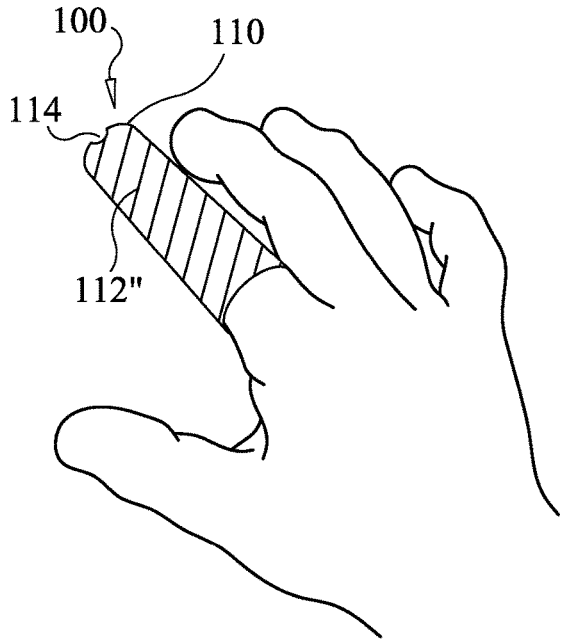
Figure 1D:
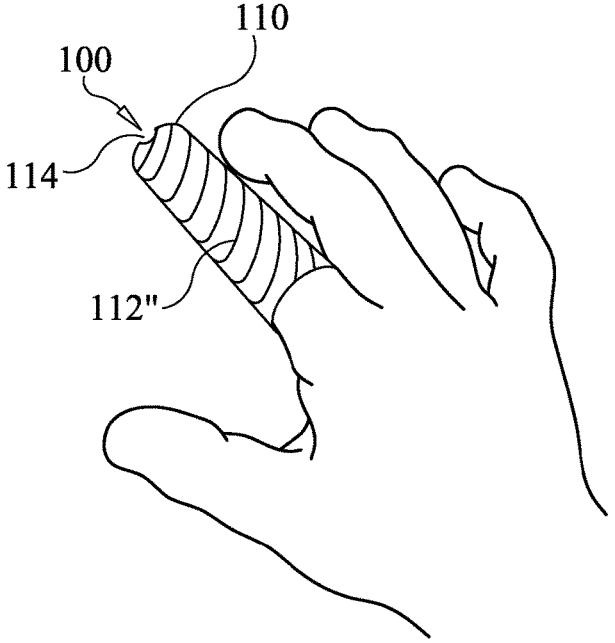
Figure 1E:
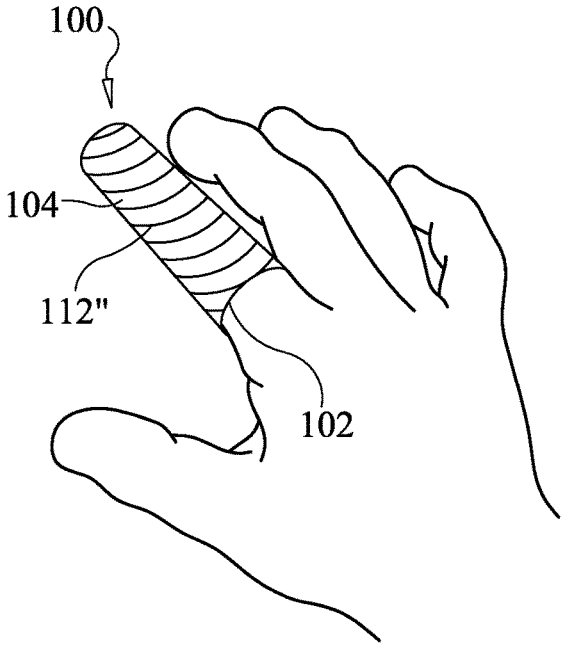
Figure 1F:
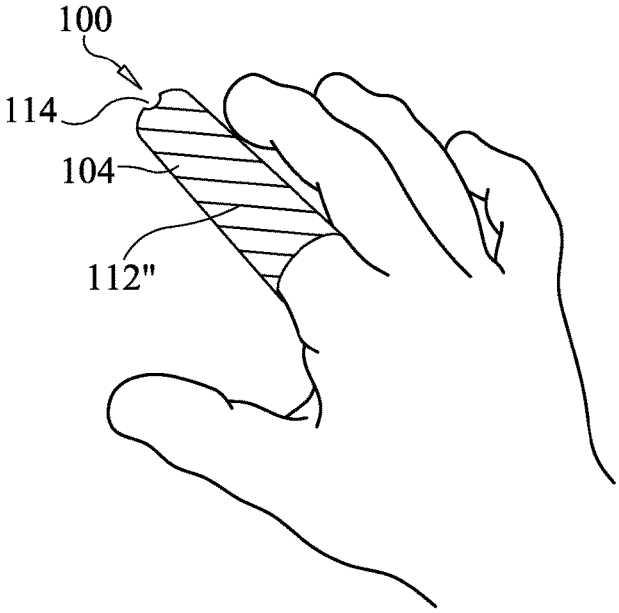
Figure 1G:
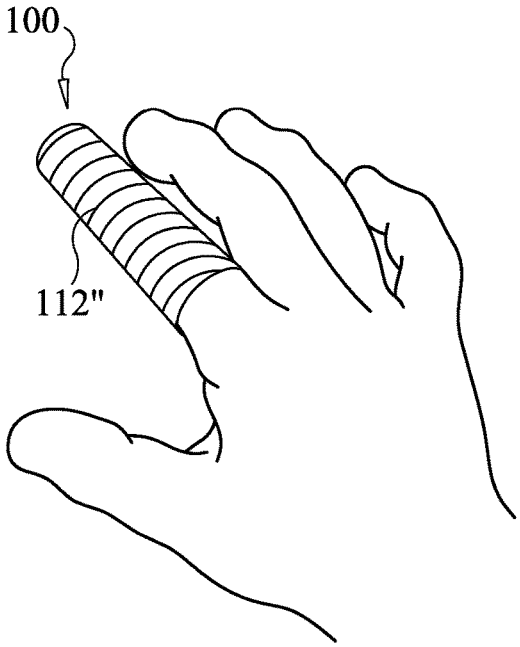
Figure 1H:
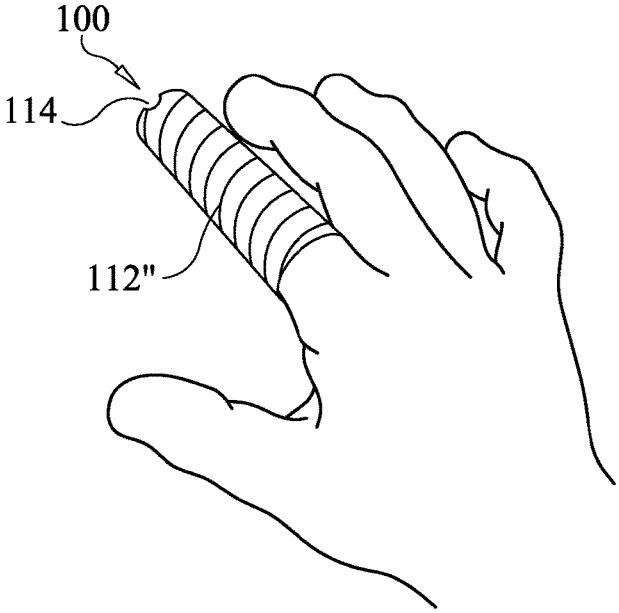

FIGS. 1A through 1L each show the hair styling finger tool 100 in accordance with various embodiments. Finger tool 100 may comprise a flexible body 102 with an elongated tubular member 104 formed in the shape of a human finger (shown exemplarily as 106) and tapered at a closed end 108 forming a conical tip 110, wherein the elongated tubular member 104 is configured to slidably fit on an entirety of the human finger 106 while leaving the rest of a user's hands (palm and/or back of the hand) uncovered; wherein the flexible body 102 comprises a plurality of hair guiding elements 112 disposed on the entirety of the tool's elongated tubular member 104; and securing means 114 positioned at the conical tip 110 at the closed end 108 of the elongated tubular member 104.

Body 102 may be formed of a material having a thickness (and thus the body may have a thickness) in the range of 0.25 mm through 2.5 mm, with a preferred thickness in the range of 1.0 mm through 2.0 mm, which provides an optimal level of flexibility in the material, while maintaining the necessary rigidity required to impart the coefficient of friction properties against hair as discussed herein. In some embodiments, body 102 may be 1 to 4 inches in length, with a preferred range of 2 to 3 inches (again, for embodiments without a rigid point 120). Embodiments with rigid point 120 may add an additional 0.25 to 1 inch to this range. Body 102 may be formed of a stretchable or flexible material that fits snuggly on a range of finger sizes. Preferred sizing will be for small, medium, and large finger diameters and circumferences, e.g., a medium ring size in the United States is 6-8 (average U.S. ring size is 7).

As used herein, the elongated tubular member 104 refers to that portion of the body 102 that comprises of a long hollow portion formed in the shape of a tube that runs the length from an open end 116 of body 102 (shown in FIG. 3) through which the finger 106 is inserted to the opposite end, which can be a closed end 108, usually positioned where the end of finger 106 and a fingernail resides while positioned inside tool 100. The closed end 108 is tapered to securely fit forming a conical tip 110.

In some embodiments, the hair guiding elements 112 may comprise a variety of different types of elements, such as, but not limited to, studs 112 (shown in FIG. 1A), bristles 112' (shown in FIG. 1B), grooves 112" (shown in FIGS. 1C-1L), and or smooth (not shown). Elements 112 may be distributed on the flexible body 102 in any one or more of the following manner: randomly, uniformly, evenly, vertically, or horizontally. In some embodiments, distribution of the elements 112 is over the entirety of the tubular member 104, while in other embodiments, elements 112 may be limited to certain portions of tubular member 104's area. Having the elements 112 distributed uniformly over the entirety of the elongated tubular member 104 provides the added benefit of a more usable tubular member 104's area.

Figure 2A:
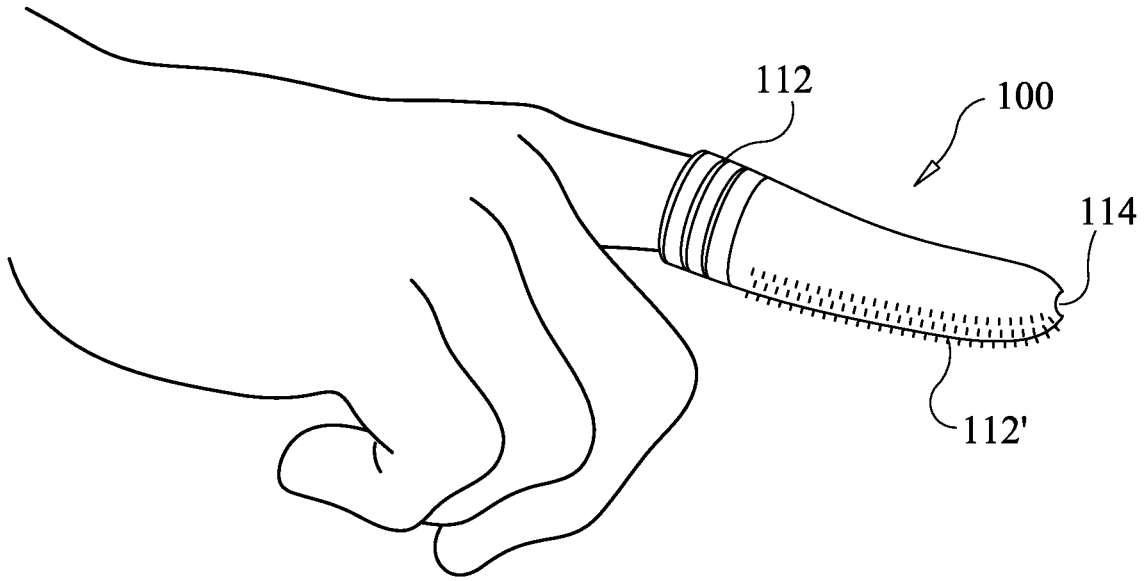
FIGS. 2A-2S each shows a hair styling finger tool in accordance with one or more embodiments.
Figure 2B:
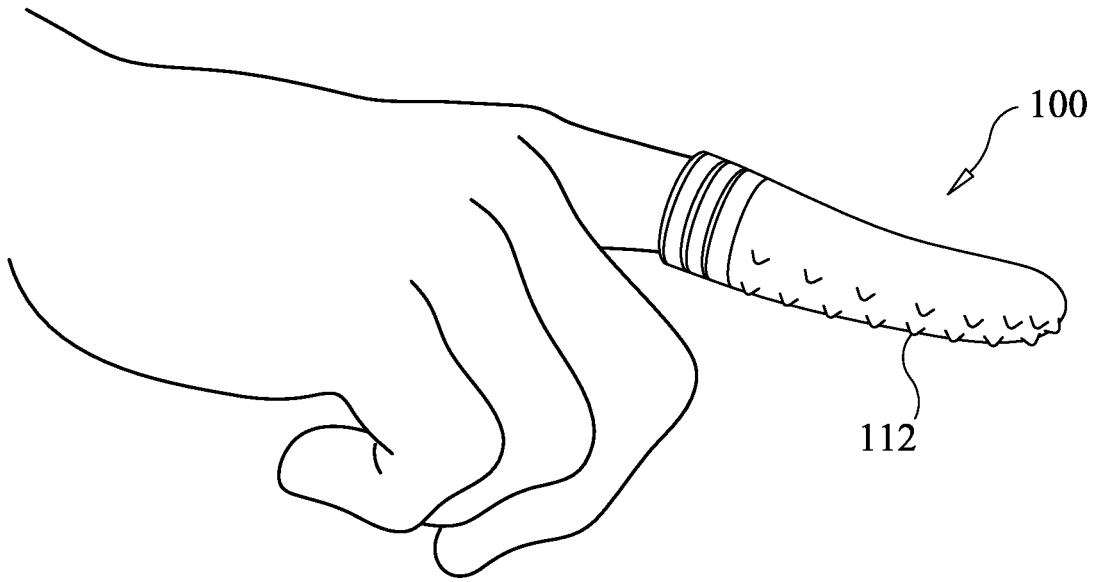
Figure 2C:
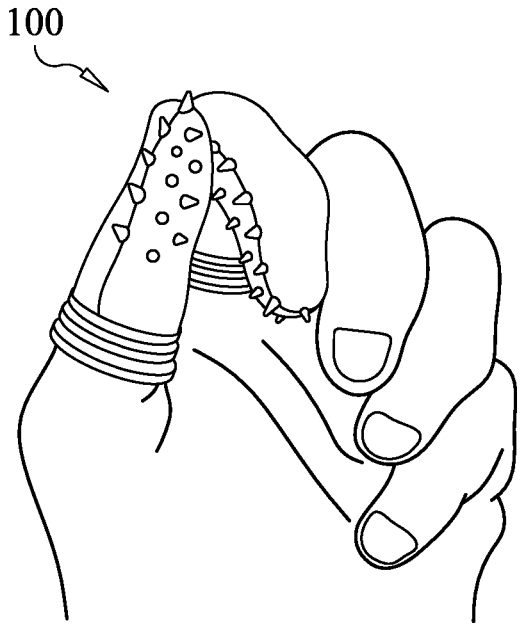
Figure 2D:
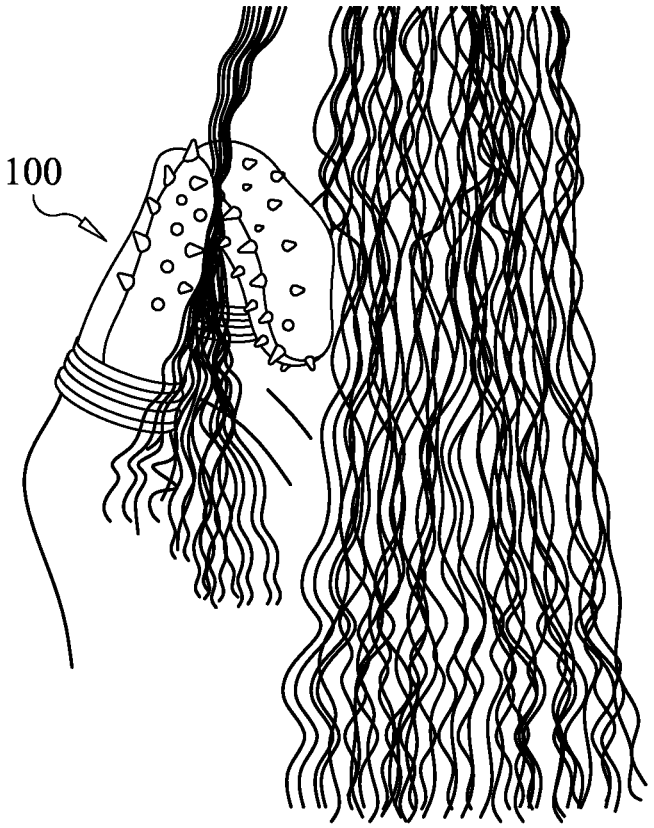
Figure 2G:
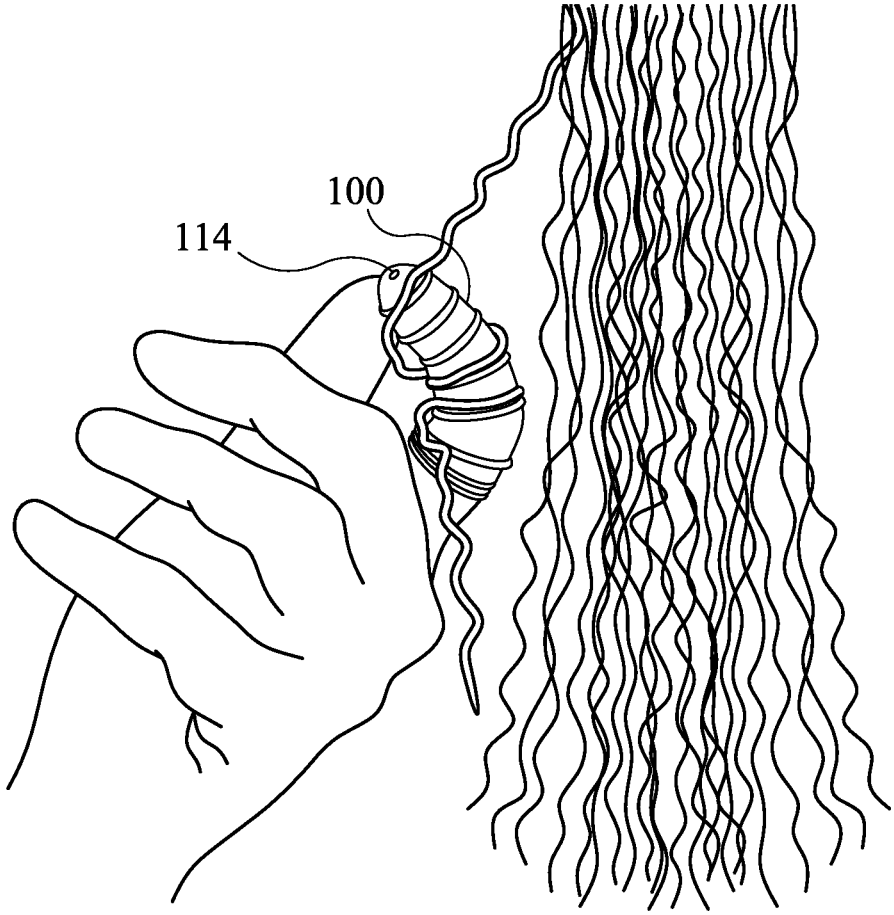
Figure 2H:
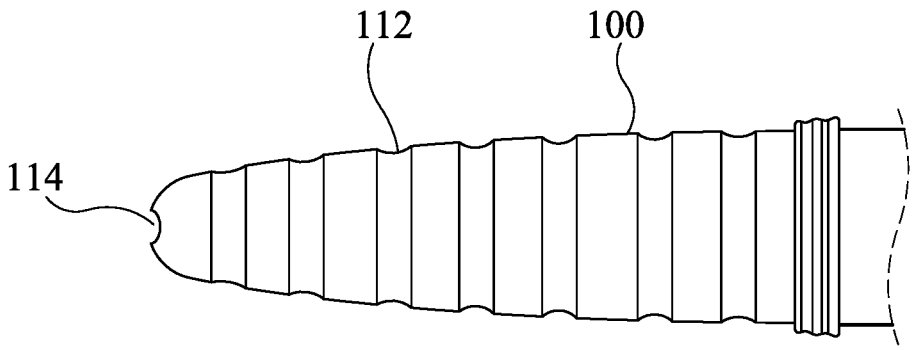
Figure 2I:
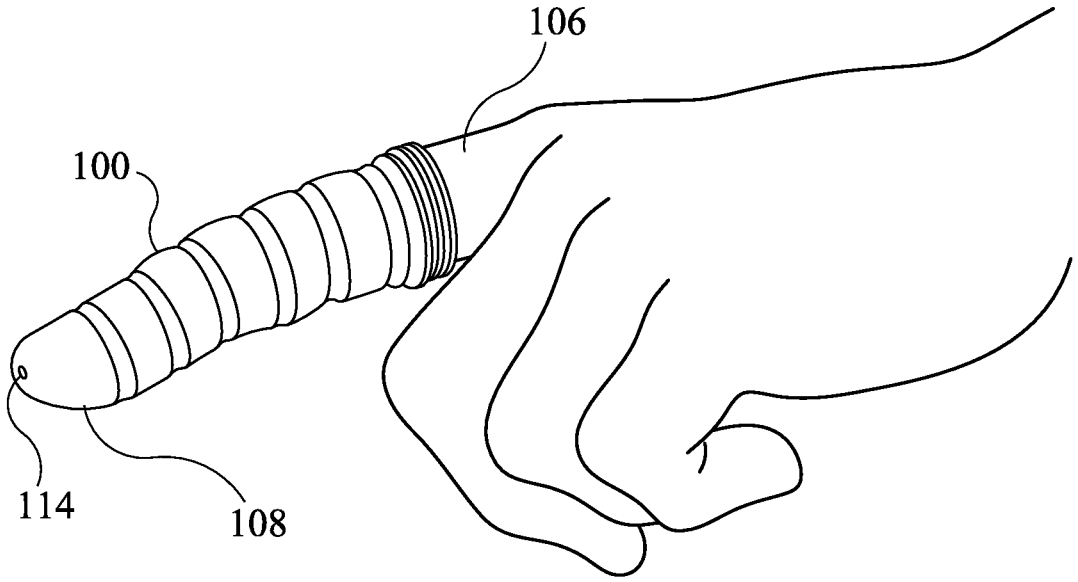
Figure 2J:
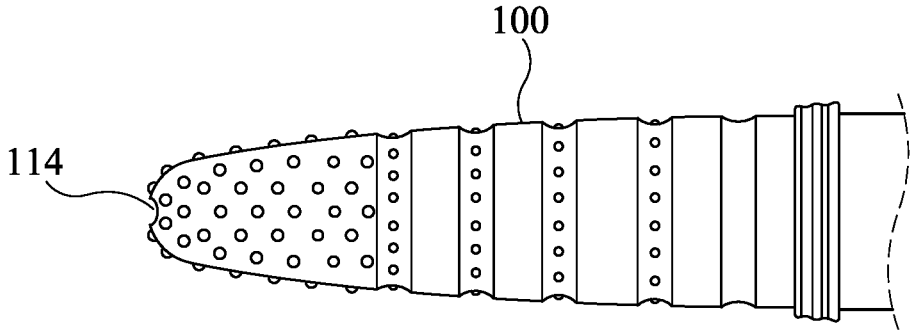

In other embodiments, part(s) of the elongated tubular member 104 is covered in a combination of one or more different type of elements 112, for example studs and grooves as shown in FIGS. 2A-2B. This provides the added benefit of allowing a user to use one tool 100 to perform different styling methods, and the flexibility of using at least one or more elements 112 simultaneously or consecutively. For example, where the elongated tubular member 104 comprises of plurality of different types of hair guiding elements 112 disposed on a singular tool 100, the elements 112 may comprise of a combination of any of the following: a plurality of studs; plurality of bristles; and/or plurality of grooves, which according to the type of element 112 used, can result in a different style result.

In some embodiments, tool 100 may be sized specifically for certain types of fingers, such as thumb, index finger, middle finger, ring finger, and/or pinky. The sizing may be based on averages of human fingers, and may be termed "small," "medium," "large," and the like, and may be based on gender, depending on where the sizing of a tool 100 falls on the range of human finger average sizes (from the smallest to largest) as shown in FIG. 1Q.

Figure 1I:
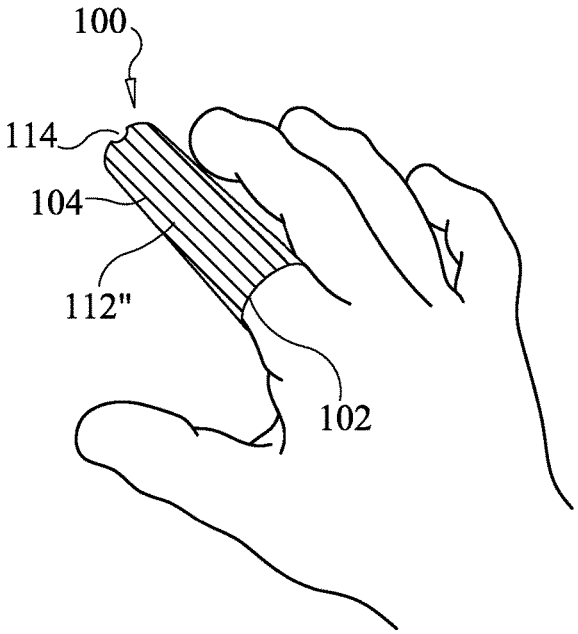
Figure 1J:
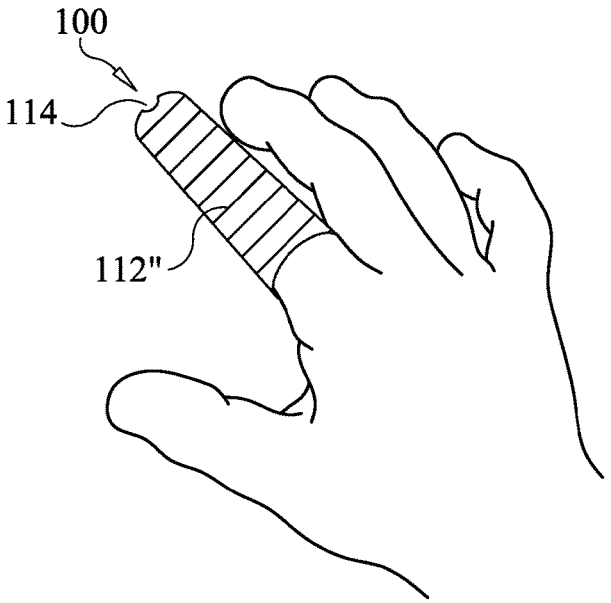
Figure 1K:
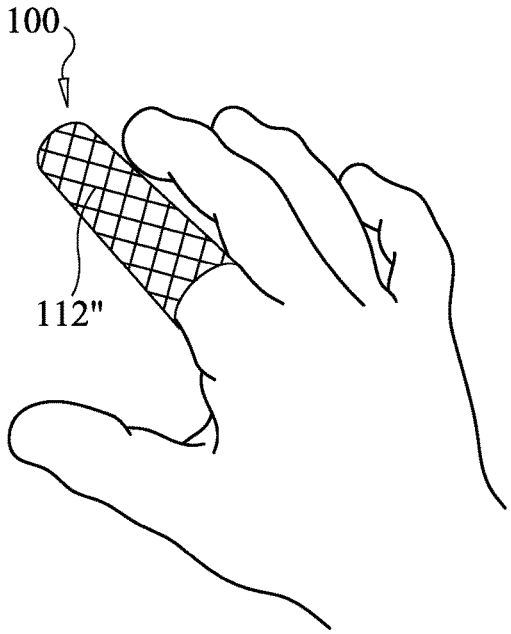
Figure 1L:
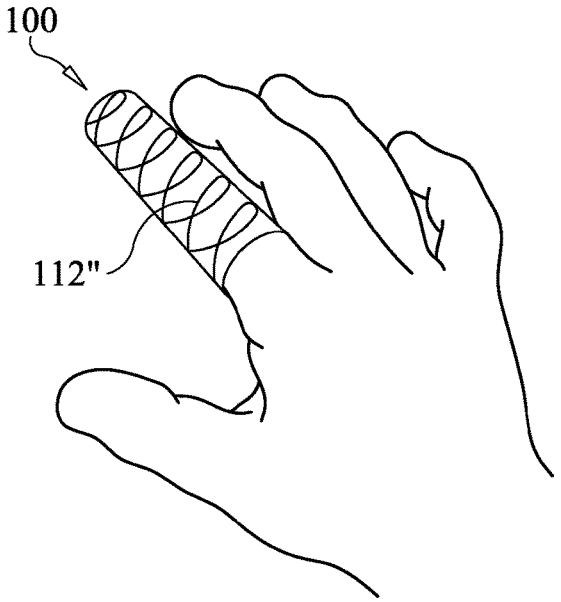
Figure 1M:
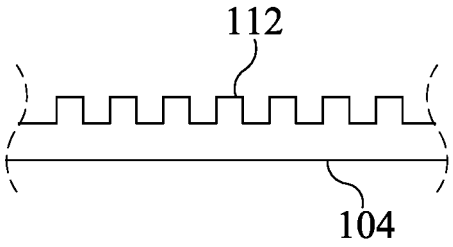
FIGS. 1M-1P each shows a cross-section of a hair styling finger tool in accordance with one or more embodiments.
Figure 1N:
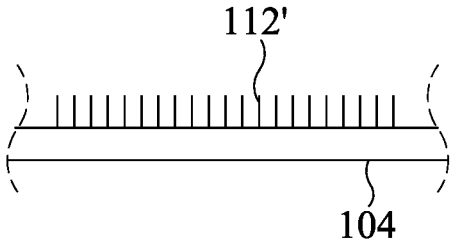
Figure 1O:
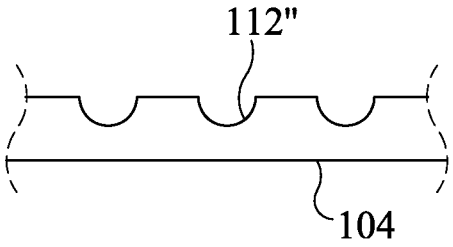
Figure 1P:
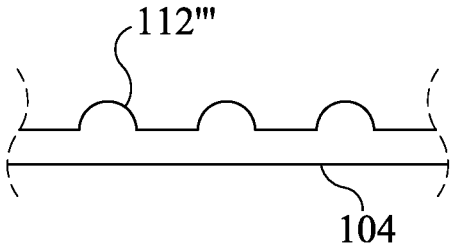
Figure 1Q:
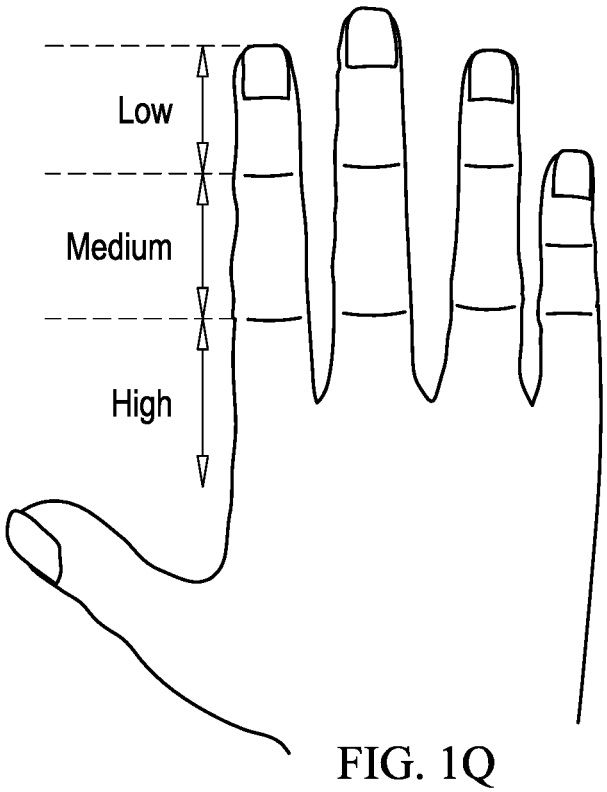
FIG. 1Q shows exemplary length designations illustrated on a hand and finger.

FIGS. 1C-1L show grooves 112" in some embodiments that may be straight or curved and arching or proceeding in different directions on the flexible body's 102 elongated tubular member 104. Grooves 112" in one embodiment may be substantially parallel to each other disposed horizontally along the elongated tubular member 104 as shown in FIGS. 1C-1J, or in another embodiment disposed vertically along the length of the elongated tubular member 104 (as shown in FIG. 1I), or in yet another embodiment, may intersect with each other, as shown in FIGS. 1K and 1L, or positioned at the base of tool 100 (as shown in FIGS. 2A-2D). In some embodiments grooves 112" may comprise one or more grooves, such as, but not limited to, grooves formed in a spiral or corkscrew extending along the elongated tubular member 104. In yet another embodiment, grooves 112" may comprise inverted grooves, such as ridges 112''', as shown in FIG. 1P.

FIGS. 1M through 1P show cross-section views of the elongated tubular member 104 and the various embodiments of hair guiding elements 112.

In another embodiment, tool 100, body 102, elongated tubular member 104 and/or elements 112 are formed of rubber. In yet another embodiment, tool 100, body 102, and/or elements 112 are formed of another substance or material having a dynamic surface-to-hair coefficient of friction in the range of 0.15 through 0.75. Having dynamic friction between tool 100, body 102, and/or elements 112 is advantageous because the friction between these components and hair moving along them helps impart styling to the hair, such as by helping form coils or curls, or inducing coils or curls to form, or straightening the hair.

Referring now to FIG. 1Q, the length of body 102 may also be described in terms of "low," "medium," and "high" lengths, with "low" meaning from tip of finger to first joint (knuckle), "medium" meaning from tip of finger to second joint (knuckle), and "high" meaning from tip of finger to third, final joint (knuckle). In some embodiments, the thickness of material from which body 102 is formed may decrease as the length increases. Thus, a low version of body 102 may have a greater thickness than medium and high versions of body 102, and a high version of body 102 may have a smaller thickness than medium and low versions, with a medium version of body 102 having a thickness less than the low version's thickness, and greater than the high version's thickness.

In yet another embodiment, body 102 may comprise a unitary body, meaning that the body 102 and elements 106 are formed of unitary substance or material. This may make manufacturing of tool 100 easier, since methods such as molding, including injection molding, may be used. Tool 100 includes securing means 114 positioned at the conical tip 110 of the closed end 108 of the elongated tubular member 104 of the tools' flexible body 102. In some embodiments, securing means 114 comprises a flexible, expandable aperture that systematically expels air from the tool 102 by suctioning out the air when a finger 106 is being inserted into the tool 100. As air is being expelled from the tool 100, it produces a partial vacuum and procures adherence of the tool 100, by gripping the finger 106 and securing the tool 100 on to the finger 106 for use. In some embodiments the securing means 114 is expandable enough to accommodate a fingernail, securely fitting the tool 100.

Figure 2N:
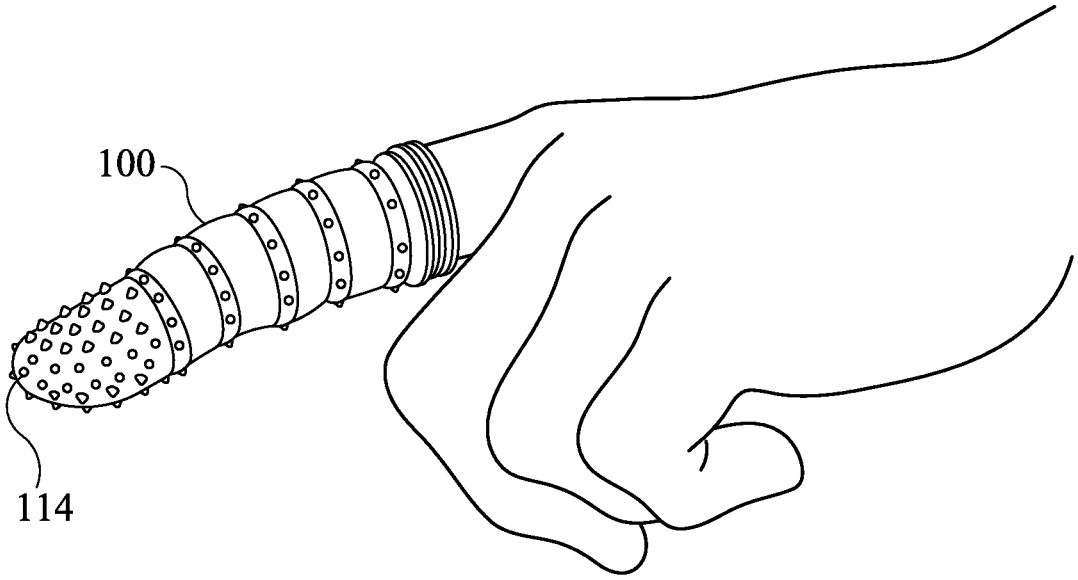
Figure 2O:
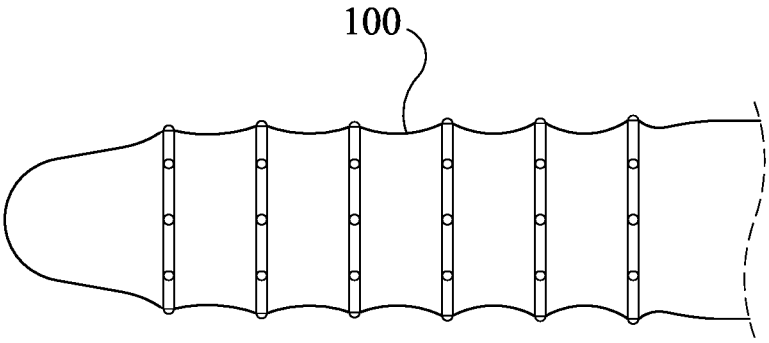
Figure 2P:
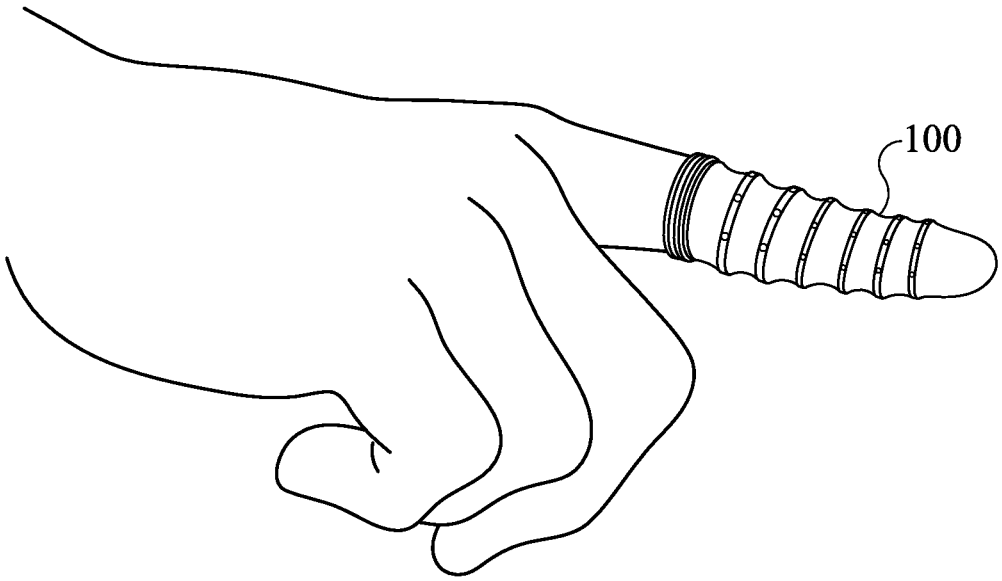
Figure 2Q:
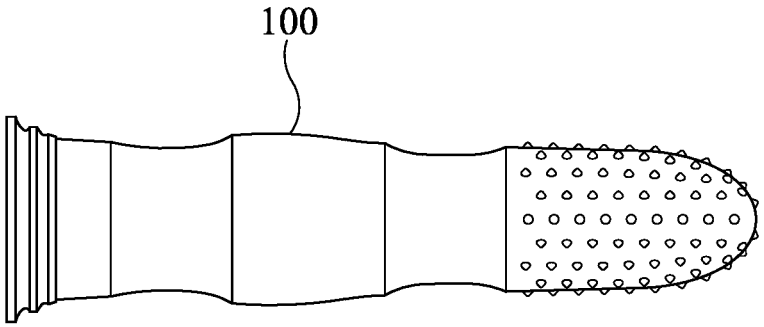
Figure 2R:
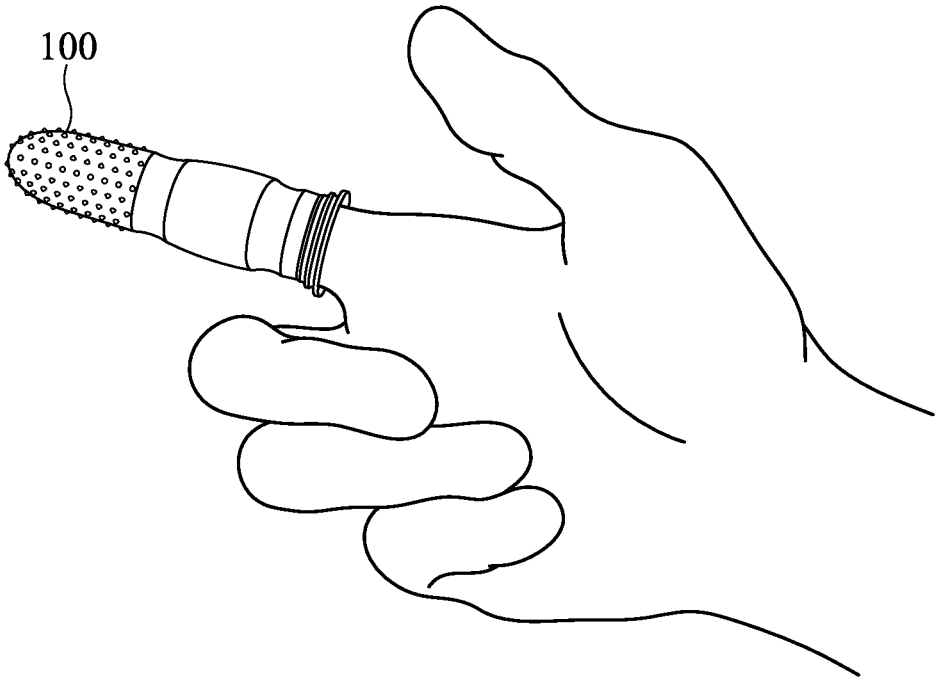
Figure 2S:
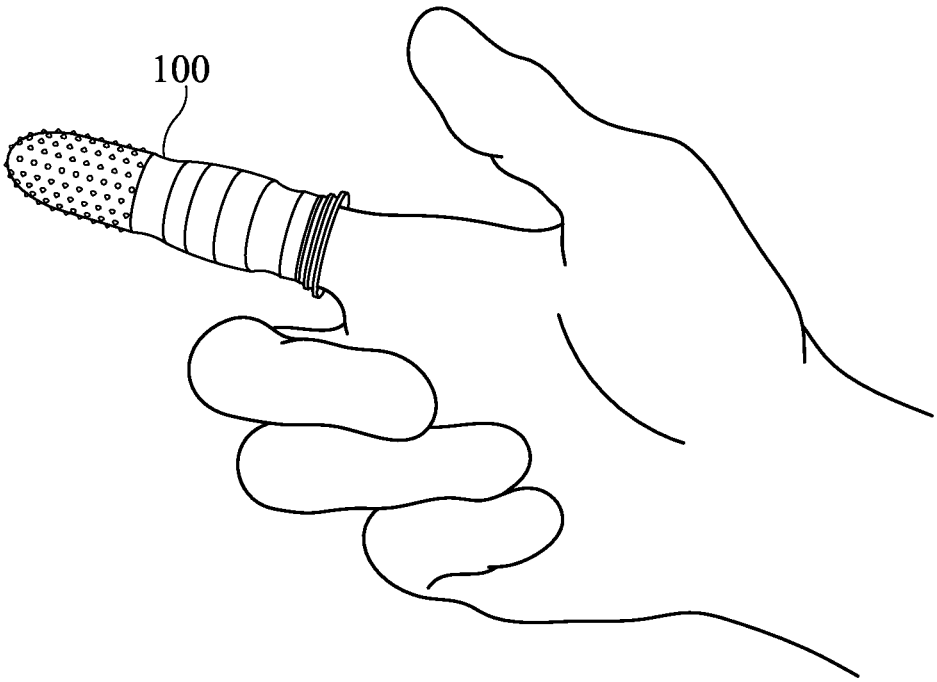

FIGS. 2A-2N show hair styling tools 100 in accordance with various embodiments, some of which feature multiple types of hair guiding elements 112 on a single tool 100, others feature hair guiding elements 112 disposed in different sections of the flexible body's 102 elongated tubular member 104. In some embodiments, the different types of elements 112 are orderly arranged along the elongated tubular member 104 with spacing, which can be uniformed or random, in between the different types of elements 112.

Figure 3:
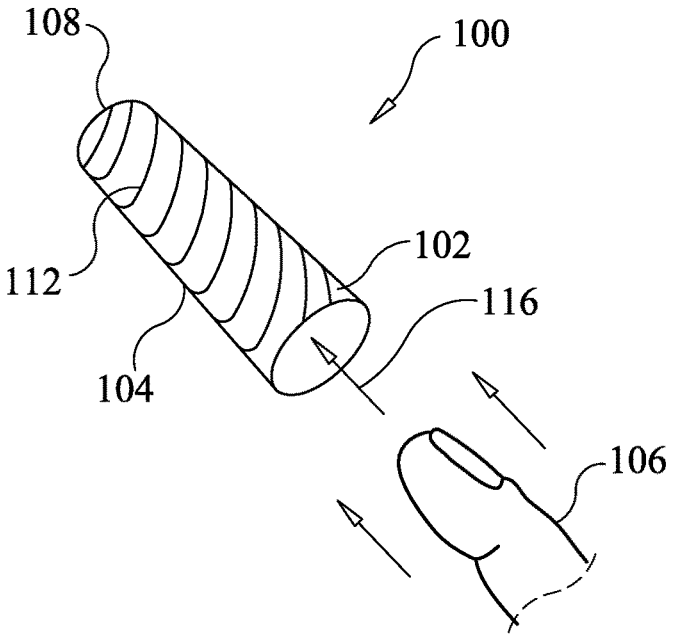
FIG. 3 shows a hair styling finger tool in accordance with one embodiment.

Referring now to FIG. 3, in some embodiments tool's elongated tubular member 104 of the body 102 may comprise an open end 116 configured to receive a finger 106, and a closed end 108. Positioned on the closed end 108 is securing means 114 configured for securing the tool 100 unto the finger 106 for use. In some embodiments, closed end 108 may comprise a rounded, or uniformly rounded end, while in other embodiments closed end 108 may comprise a rigid point 120 as shown in FIGS. 5A & 5B.

Figure 4:
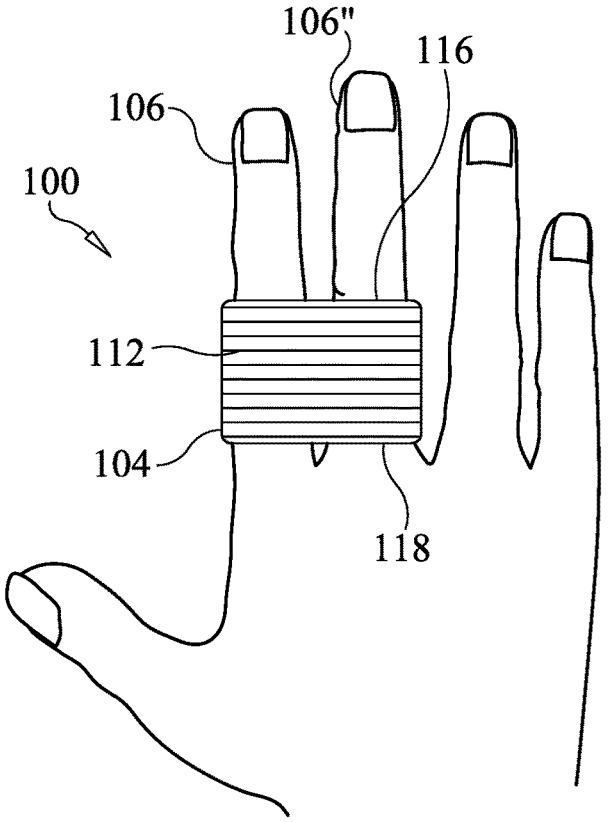
FIG. 4 shows a hair styling finger tool in accordance with another embodiment.

FIG. 4 shows a finger-pad type tool 100 in accordance with yet another embodiment. Tool 100 comprises a flexible body 102 with an elongated tubular member 104 comprising of two open ends 116, 118, configured to slidably fit on a portion of two or more human fingers 106, 106' while leaving the rest of the user's fingers and hand (palm and/or back of the hand) uncovered. The finger tool 100 is unlike a glove or mitten that engages the entire hand in a covering fully encasing the back of the hand, palm, thumb, and fingers in either two (2) separate partitions (mittens) or with individual partitions for each finger (gloves). The flexible body 102 comprises a plurality of hair guiding elements 112 112 disposed on the entirety of the tool's elongated tubular member 104. In a preferred embodiment, tool 100 may be in the shape of a sleeve or band that is slid over two of a user's fingers 106, 106', which provides improved "MCT" (defined below) effects when styling hair.

Figure 5A:
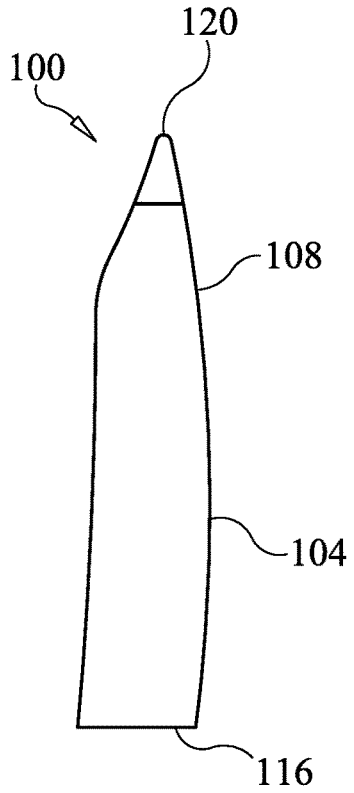
FIGS. 5A and 5B show a hair styling finger tool in accordance with yet another embodiment.
Figure 5B:
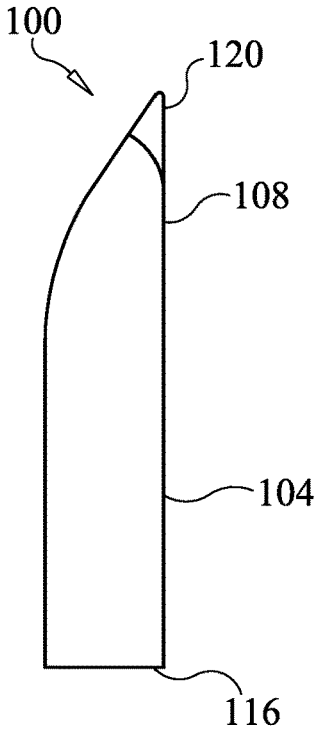

FIGS. 5A and 5B (side view) show other embodiments of the tool 100, whereby tool 100 tapers at a closed end 108 into a rigid point 120. Rigid point 120 may be formed of the same flexible material as body 102, but with a greater thickness so as to be less flexible and more rigid than body 102. In another embodiment, rigid point 120 may be formed of a different, more rigid material than body 102, and may be affixed to body 102, such as by gluing, melting, or other form of bonding. For example, rigid point 120 may be formed of plastic, metal, wood, polyvinyl chloride, ceramic, glass, sapphire, bone, and the like. In some embodiments, the dynamic coefficient of friction between point 120 and hair should be less than the coefficient of friction between the rest of tool 100, body 102, and/or elements 112, and preferably, as low as possible.

In yet another embodiment, rigid point 120 may be formed in the shape of a long fingernail, to present a familiar shape, which provides the added benefit of a shorter learning curve for learning how to use tool 100. Rigid point 120 may comprise a hair separator, which may be used to separate hair strands, or groups of hair strands, and/or create parts in a person's hair.

Figure 6:
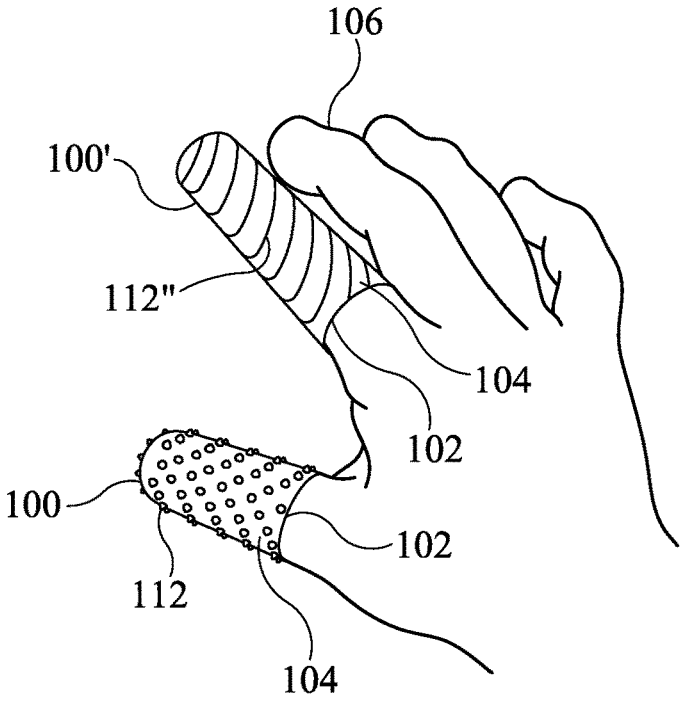
FIG. 6 shows plurality of hair styling finger tools worn on user's fingers in accordance with one or more embodiments.

FIG. 6 shows an embodiment wherein two tools 100, 100' are simultaneously used by a user to style hair. In one embodiment, one tool 100 may be used on a user's index finger 106, while another tool 100' may be used on the user's thumb. Such an arrangement is preferred for multi-tool use because a user would be able to use their primary 'tool' fingers, namely index finger and thumb, to style hair using tools 100, 100', leaving their remaining fingers and hand to manipulate the hair, use other tools 100, 100' or objects, and/or use their bare skin and touch to feel the hair and its texture, and the like.

In one embodiment, a hair styling finger tool kit comprising a plurality of hair styling finger tools 100, 100', wherein each of the plurality of hair styling finger tools 100, 100' comprises a flexible body 102 with an elongated tubular member 104 formed in the shape of a human finger 106, wherein the body's elongated tubular member 104 comprising a plurality of hair guiding elements 112, 112', and 112", disposed on the tubular member 104 of the body 102, wherein the hair guiding elements 112, 112', 112", on a first of the plurality of hair styling finger tools 100, 100' comprises a plurality of studs 112, wherein the hair guiding elements 112 on a second of the plurality of hair styling finger tools 100' comprises a plurality of bristles 112', wherein the hair guiding elements on a third of the plurality of hair styling finger tools 100 comprises a plurality of grooves 112"; and at least one of the plurality of hair styling finger tools comprises an open end 116, tapered at a closed end 108 forming a conical tip 110; and at least one of the plurality of hair styling finger tools 100' comprises an open end 116 and a closed end 108, wherein the closed end 108 comprises a rigid point 120 or a uniformly rounded end.

In some embodiments, the kit may comprise a tool 100 having two open ends 116 and 118. The kit may also comprise at least one tool 100 having securing means 114 positioned at the conical tip 110 at the closed end 108 of the elongated tubular member 104 (not for tools with two open ends 116, 118).

In yet another embodiment, the kit further comprises a set of instructions on how to use at least one of the plurality of hair styling finger tools 100, 100' to style hair, according to one or more of the methods disclosed herein. Such instructions may be written and include pictures showing the styling methods and/or steps of each method. The instructions may also be provided on a computer readable medium, such as a CD or DVD, and may include audio and/or video instructions. The instructions may be provided via a downloadable computer file, a link to which may be provided in the kit.

Each of the various types of hair guiding elements 112, 112', 112" provides a certain type of hair styling. Depending on the desired hairstyle, a user can select the most beneficial feature type of tool 100 to aid in styling. For example, the groove type elements 112" can provide guided (e.g., corkscrew-like) indentations to lead/guide the hair around the user's finger to create a smoother or larger curl or coil. The bristle type elements 112' can be used to detangle or straighten hair, and the stud type elements 112 can be used to impart curls or coils that are tighter than those formed by the groove elements 112".

While additional hair guiding elements 112 types may be provided on body 102, the types of types of elements 112 disclosed herein are preferable due to the particularly advantageous hair styling properties they possess, including providing the following results, and more, when compared to existing hair styling tools: reduces the amount of time to complete a hairstyle by 25% to 50%, provides for longer style retention in the hair (meaning that hairstyles last longer), and user fatigue is reduced since users no longer have to lay down and pick-up tools as they style hair.

For example, once a user has completed a step of detangling using a brush or comb, the user would typically rest the brush or comb and continue with styling. During styling with one's bare hand however, hair can become tangled again requiring the user to stop the process to pick up the brush or comb and detangle the hair once more. By using tool 100, user can use elements 112, 112', 112" to smooth hair to remove tangles while styling hair, thereby reducing the need to continually stop the styling process, pick up a comb or brush, detangle hair, replace the comb or brush to rest. Accordingly, tool 100 will not only reduce the effort and energy expended for styling hair but will also reduce time spent on the entire styling process, particularly the detangling process. Using tool 100 can also aid in creating consistently clean and straight part lines without the need of using a separate brush or comb. Accordingly, fewer styling tools are needed, and less time is used on this step during the styling process.

Further, many individuals primarily rely on using bare hands to perform these types of styling steps. While a bare hand may serve as a curling tool (e.g., during coiling), human skin does not provide any guided, detangling textures since it is effectively a smooth surface. Further, as explained above, many users use hair care, mousse, conditioner, curling, styling gel and chemical products with hold to style hair that get absorbed into the user's skin causing it to become irritated and pruned. Excessive time in water or covered in hair styling products, can cause the user's skin to become dehydrated or overly hydrated. Preventing your fingers from becoming excessively hydrated or dehydrated is desired especially if the user has sensitive skin. Tool 100 helps to reduce the user's contact with moisture and heat from hair styling products and tools as well.

There are numerous types of hair, ranging from thick and curly to thin and straight. The various types of hair can generally be classified under a popular classification system into a scale of twelve types: 1A, 1B, 1C, 2A, 2B, 2C, 3A, 3B, 3C, 4A, 4B, and 4C. Tool 100 and the methods disclosed herein may be applied to any type of hair texture, however, they are primarily effective for hair types 3A-3B (curly) and types 4A-4B (coily). The sub classifications—from A to C—are based upon the density and diameter of the wave, curl, or coil pattern ("A" being least dense or thick, and "C" being most dense or thick). A person's hair may have multiple hair textures ranging from hair types 1A-1C (straight) through types 4A-4C (coily). While the tools and methods disclosed herein are for spirally curly hair, organized spirally curly hair, wavy to naturally spirally, and/or tightly coiled to zig zag patterned (Afro-textured) hair, they may be used for any type of hair texture.

FIGS. 10A-11M each shows a hair styling tool 100 in accordance with one or more embodiments. As shown in FIG. 11B, tool 100 comprises a flexible body 102 with an elongated tubular member 104 comprising of two open ends 116, 118, and two open sides 122, 124 configured to slidably fit on a portion of at least two or more human fingers 106, 106' while leaving the rest of the user's fingers 106' and hand (palm and/or back of the hand) uncovered. The finger tool 100 as shown in FIGS. 10A-11M is unlike a glove or mitten as it does not fully encompass the entire hand in a covering. The flexible body 102 comprises a plurality of hair guiding elements 112, 112', 112" disposed on the entirety of the upper portion 126 and lower portion 128 of tool's elongated tubular member 104, which engage the hair for styling.

Figure 11A:
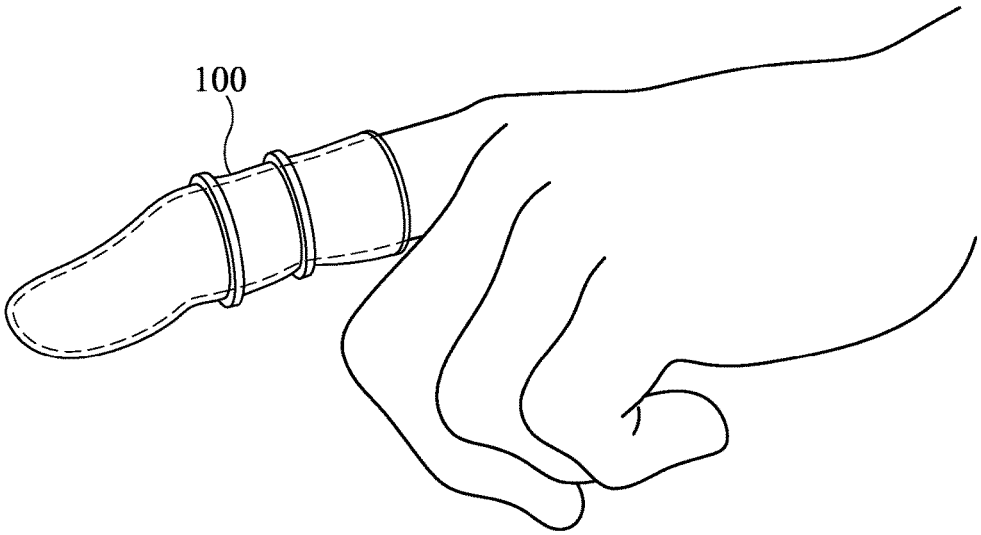
FIGS. 11A-11M each shows a hair styling tool in accordance with one or more embodiments.
Figure 11B:
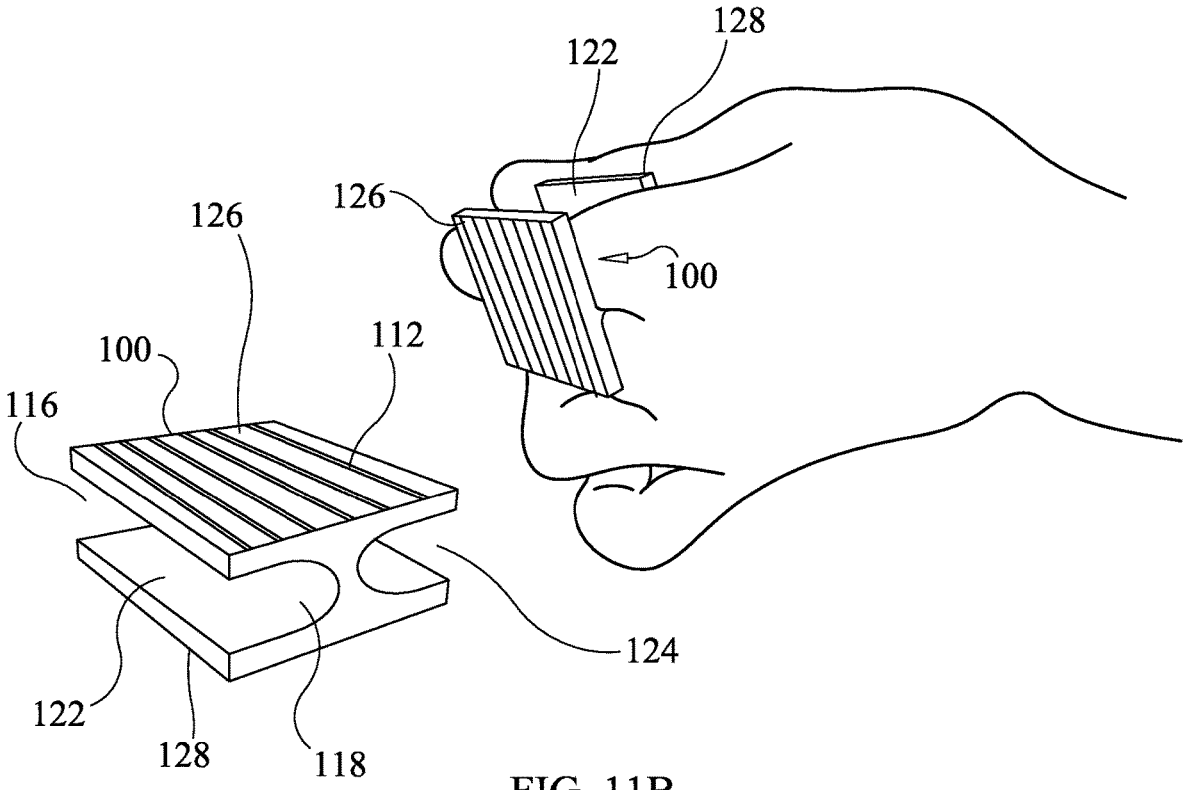
Figure 11C:
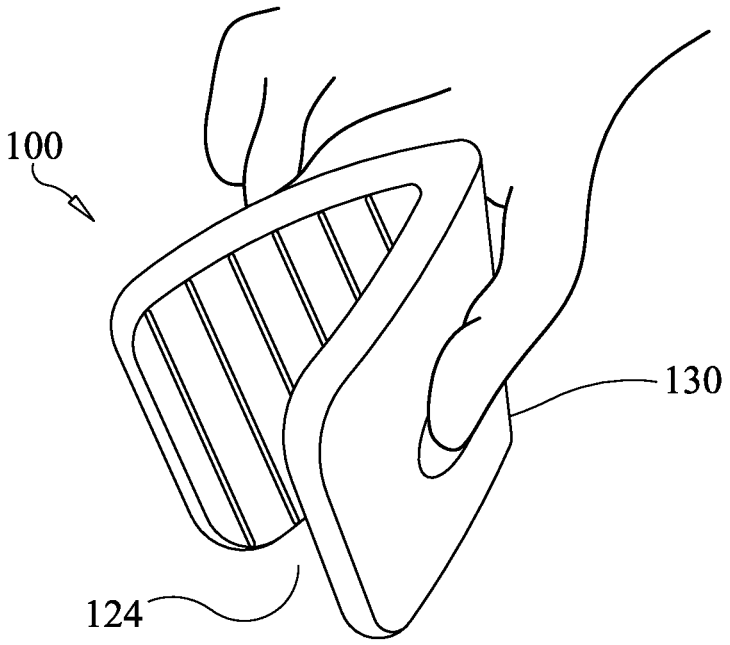
Figure 11D:
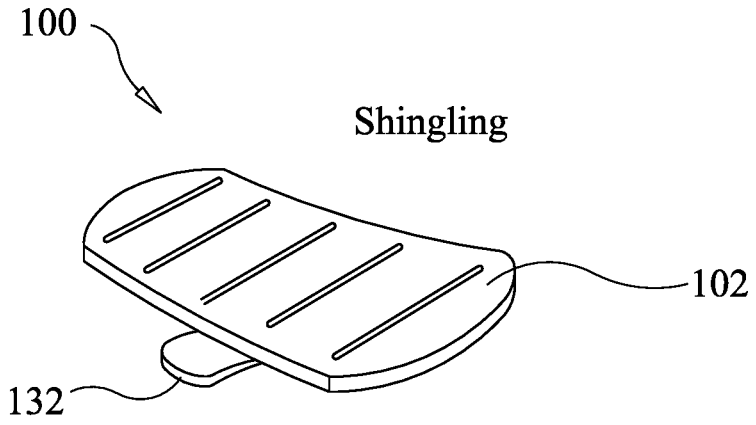
Figure 11E:
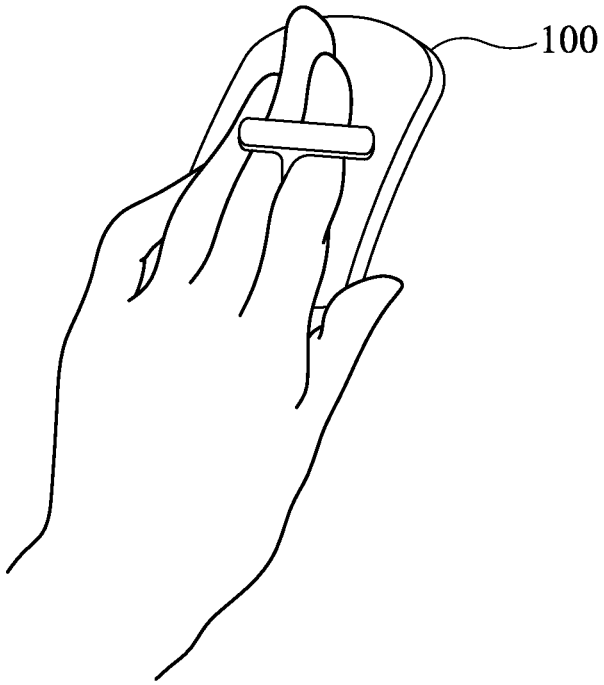
Figure 11F:
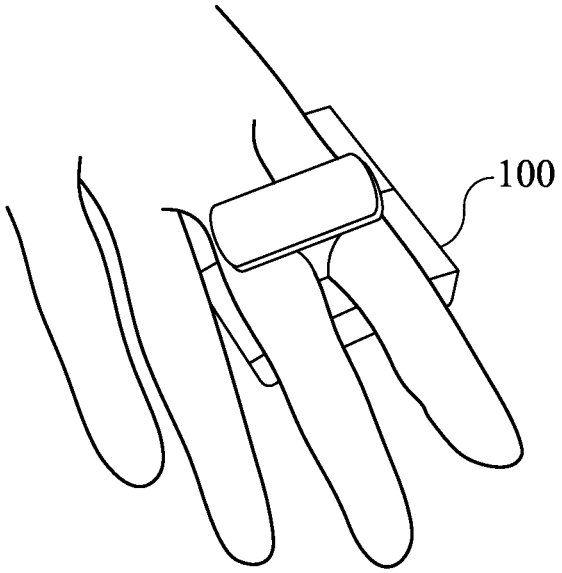
Figure 11G:
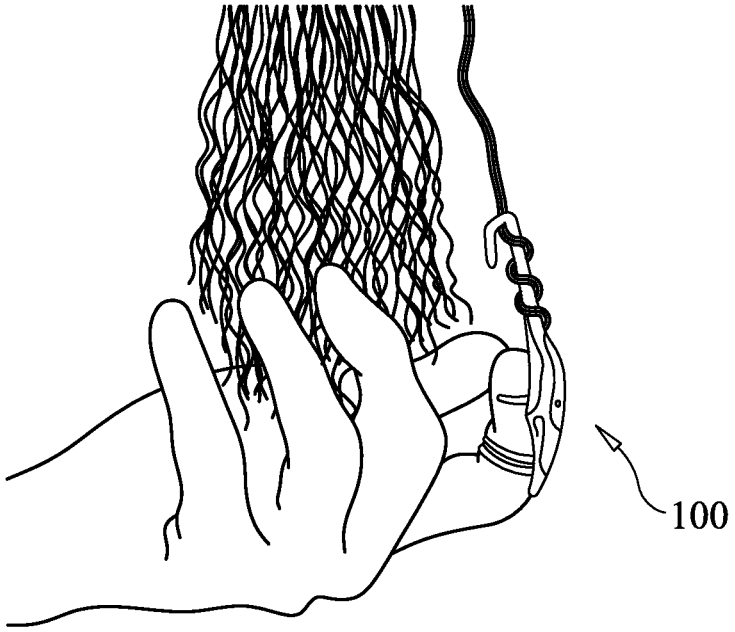
Figure 11H:
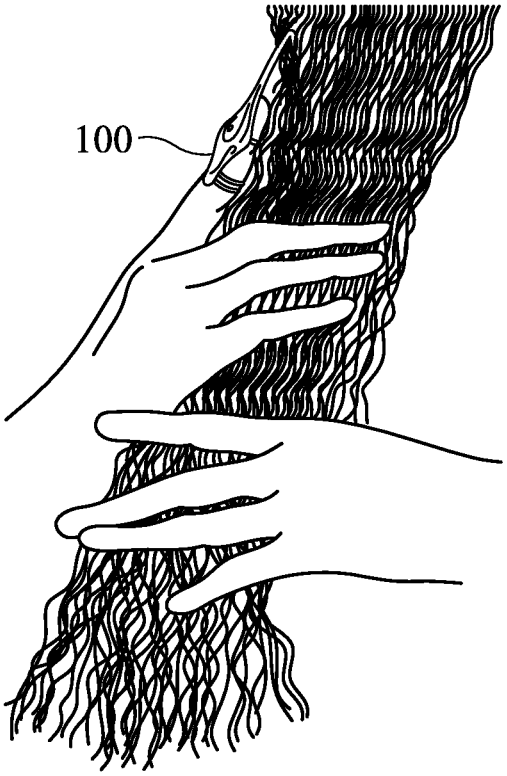
Figure 11I:
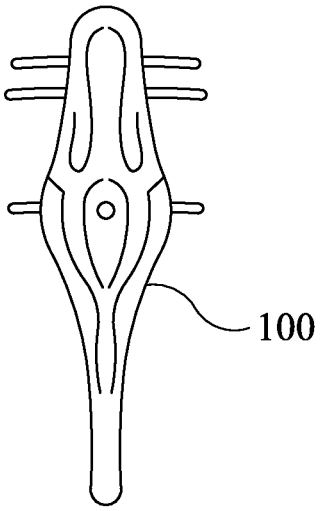
Figure 11J:
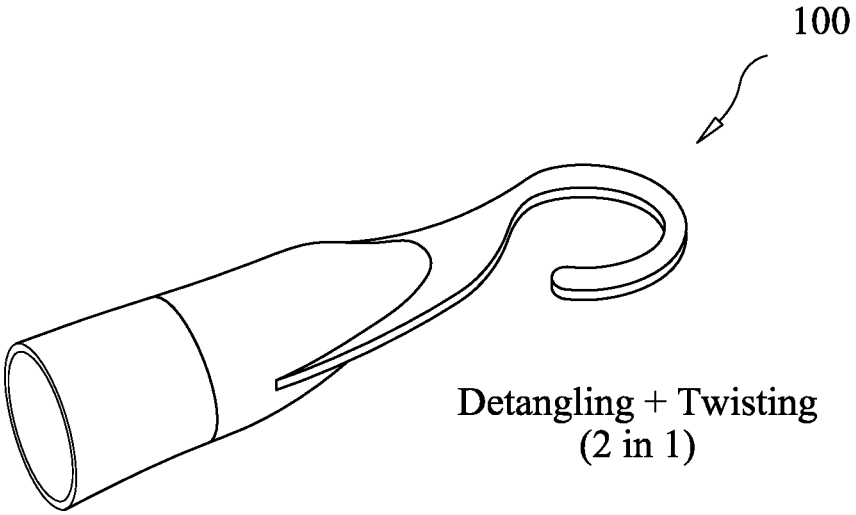
Figure 11K:
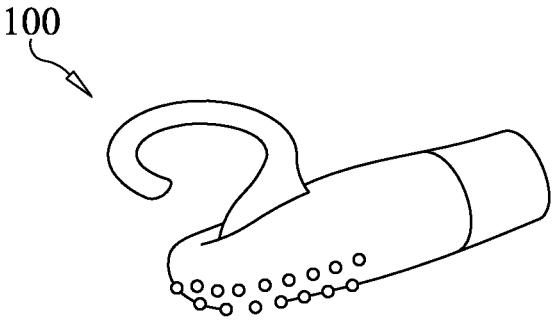
Figure 11L:
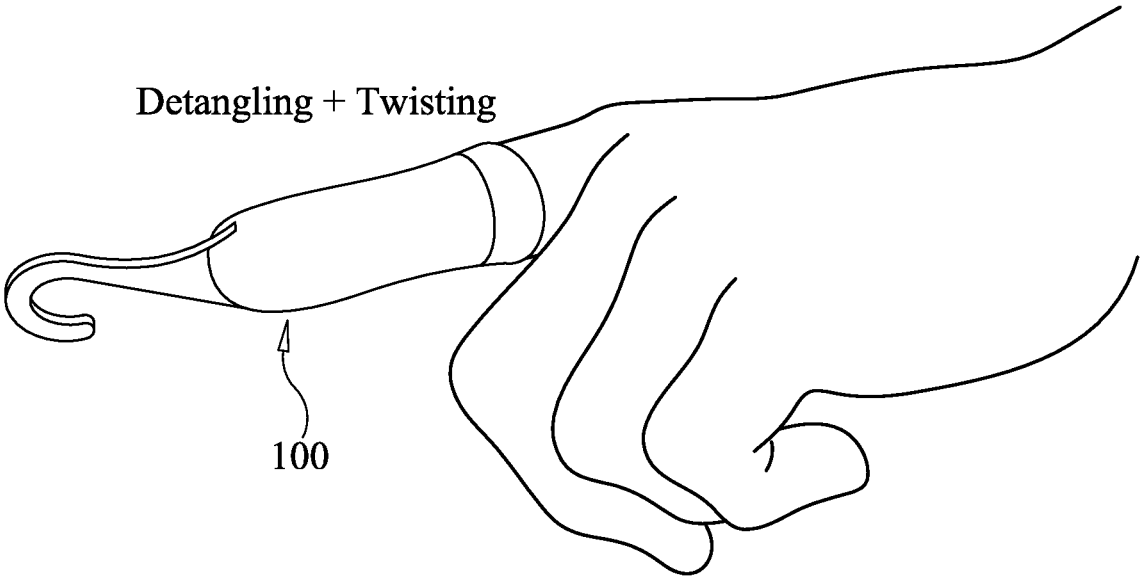
Figure 11M:
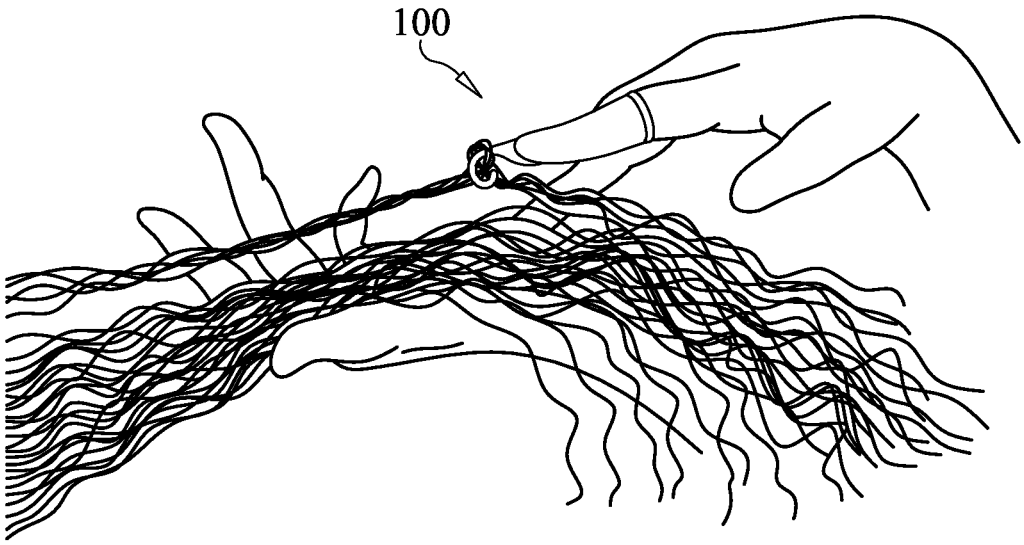
Figure 12A:
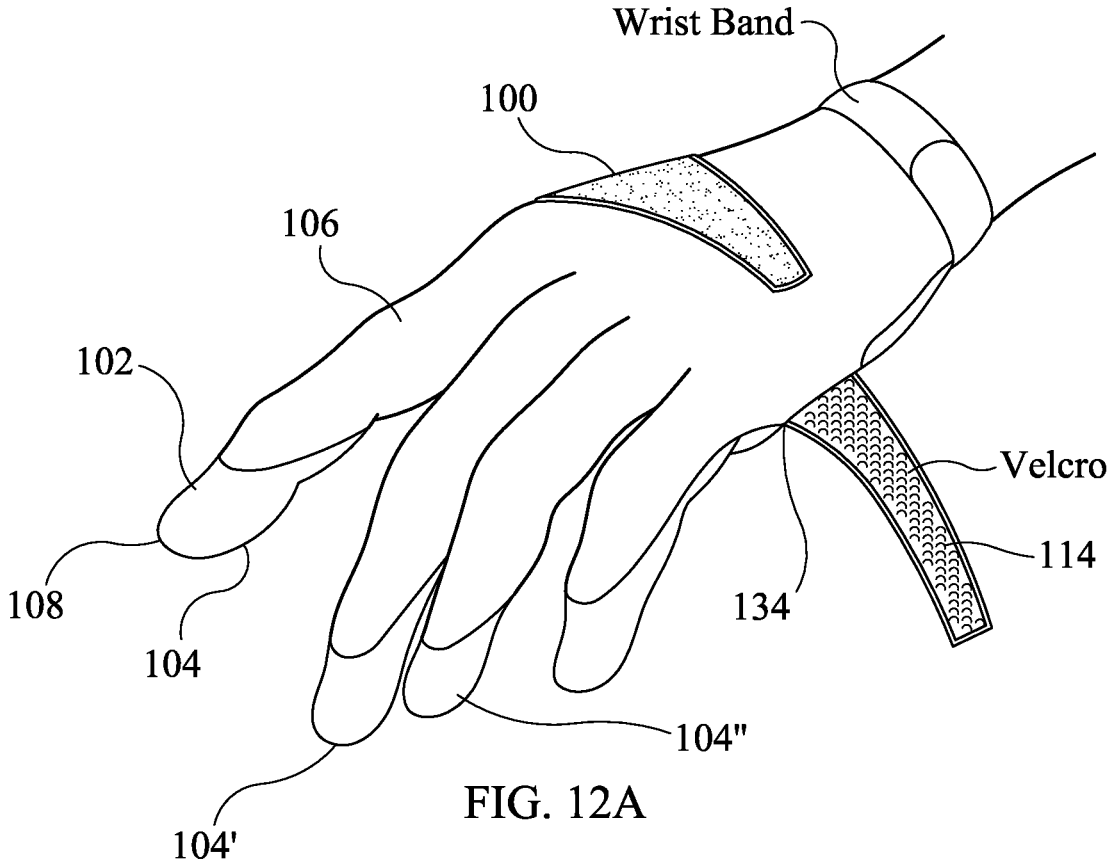
FIGS. 12A-12K each show a combination hair styling tool in accordance with one or more embodiments.
Figure 12B:
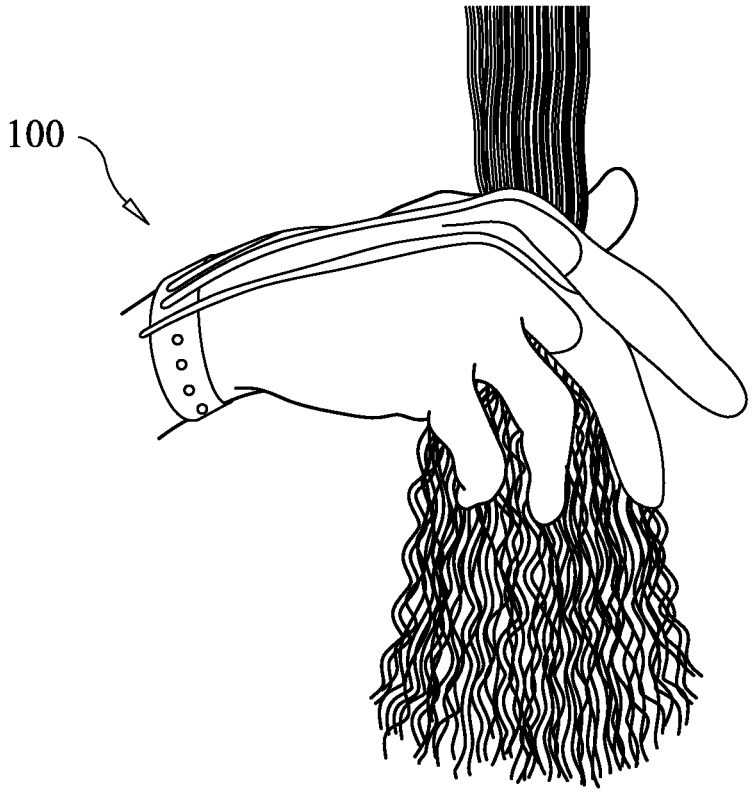
Figure 12C:
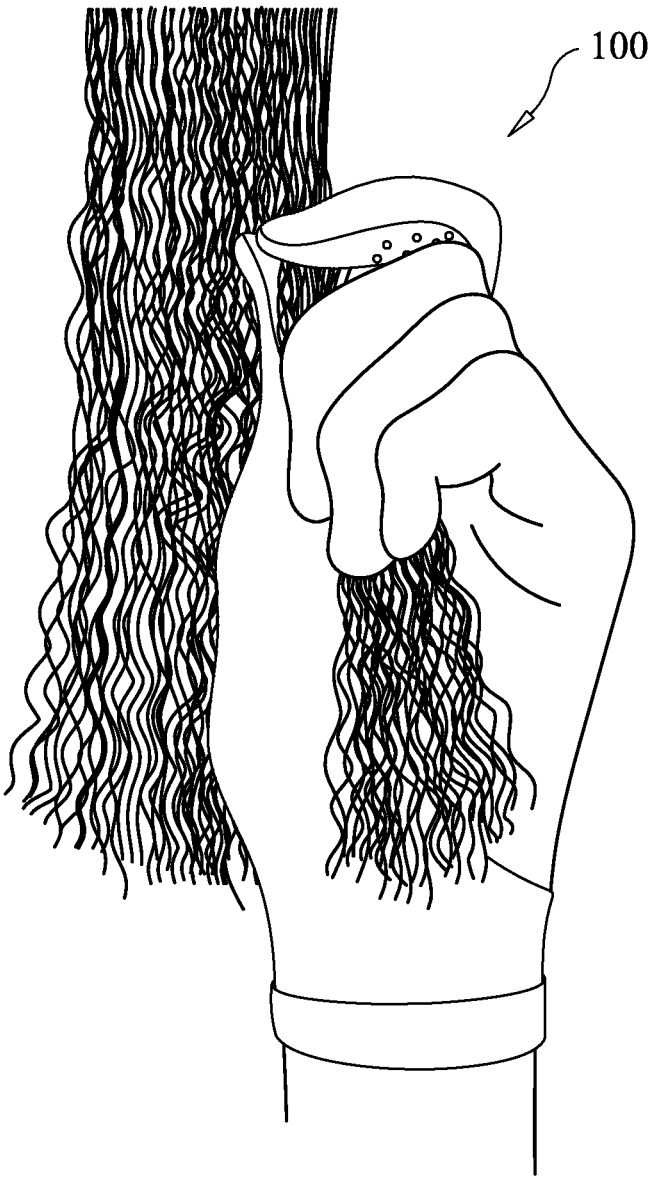
Figure 12D:
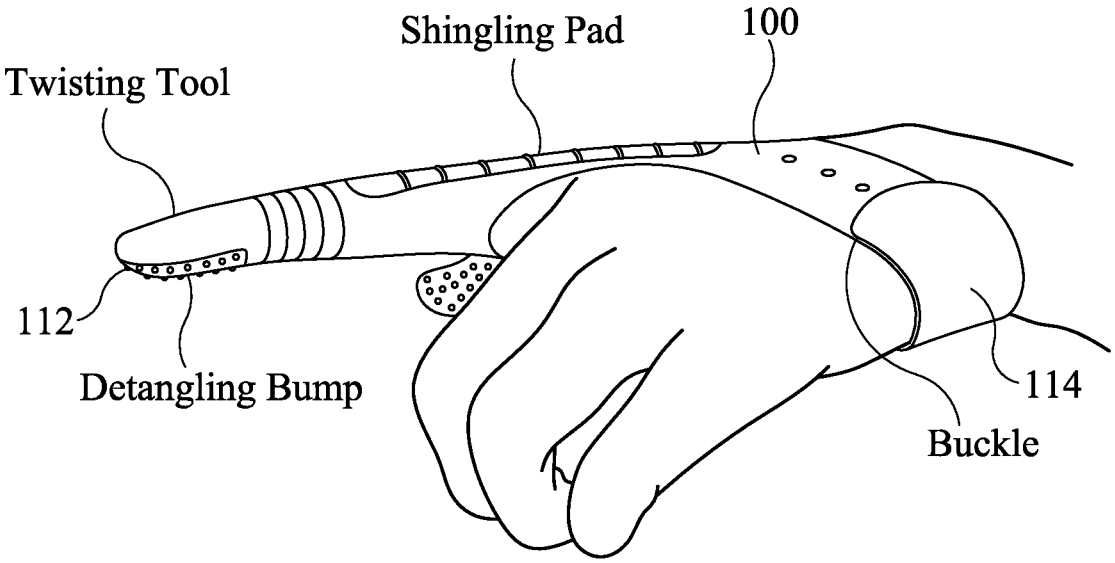
Figure 12E:
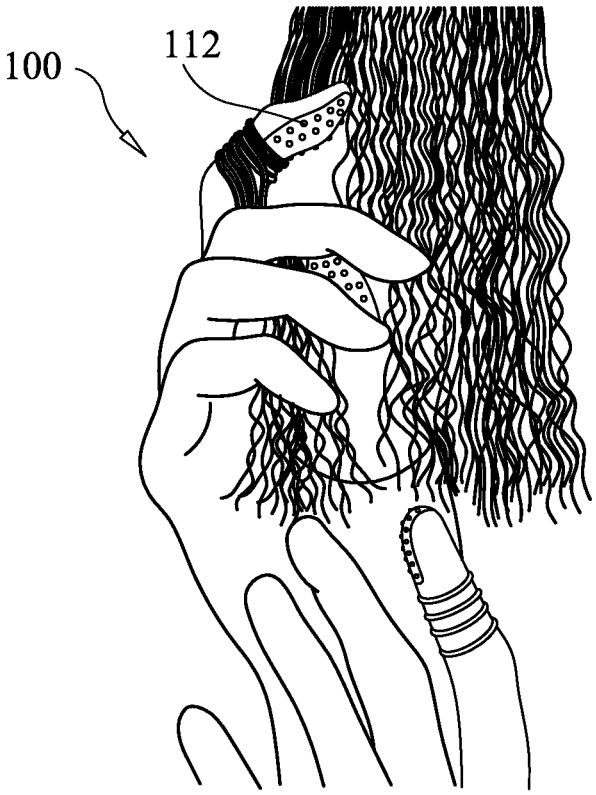
Figure 12F:
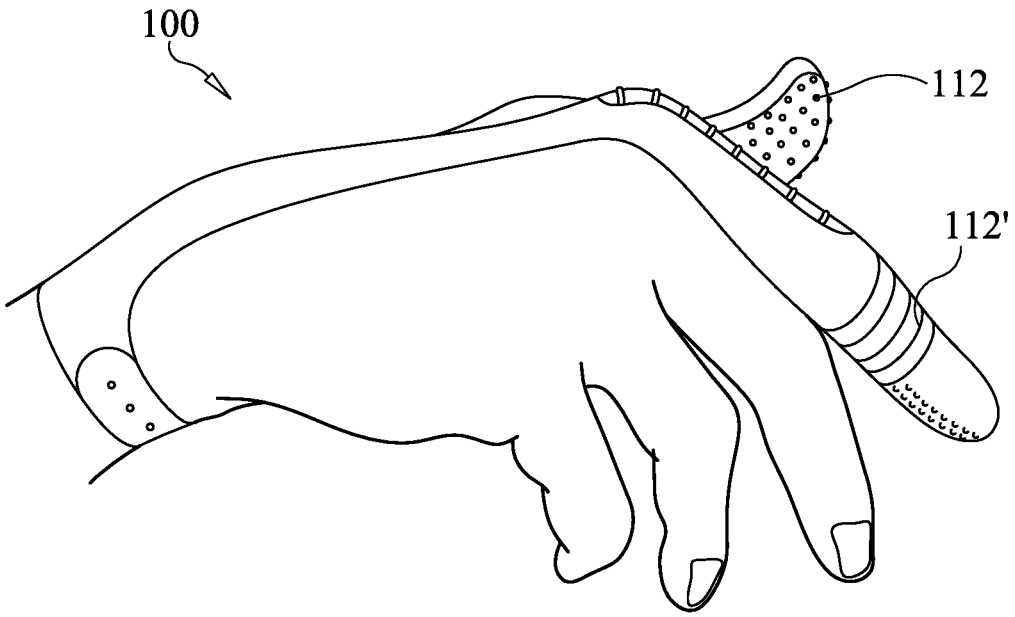
Figure 12G:
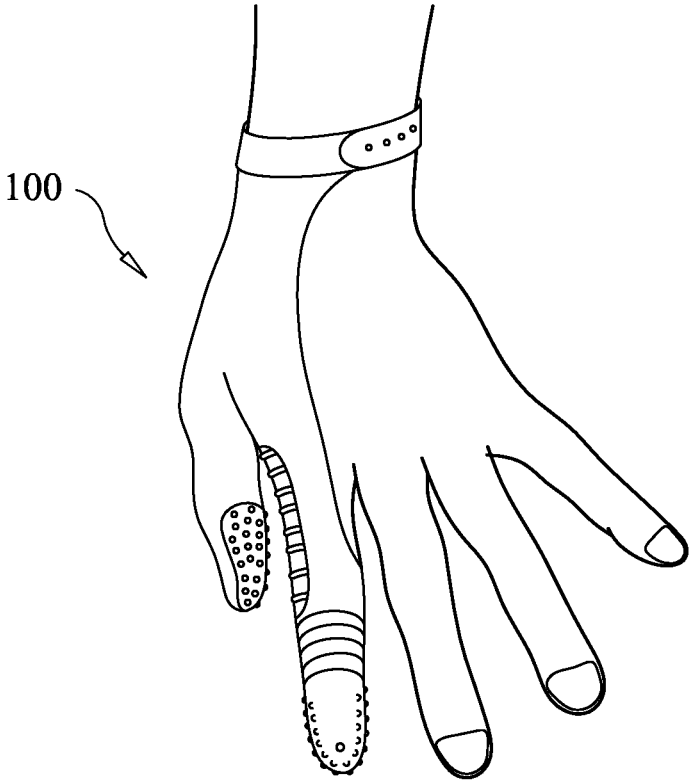
Figure 12H:
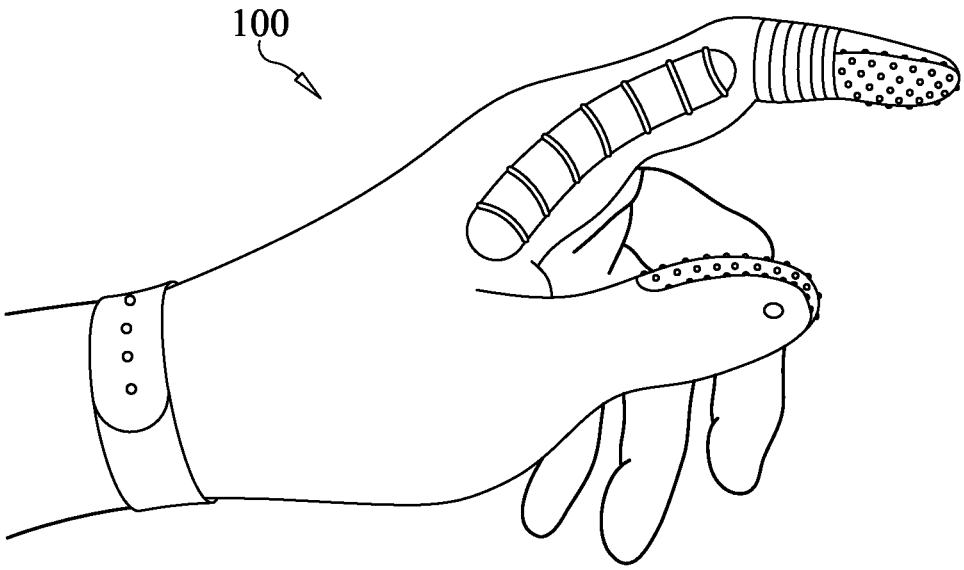
Figure 12I:
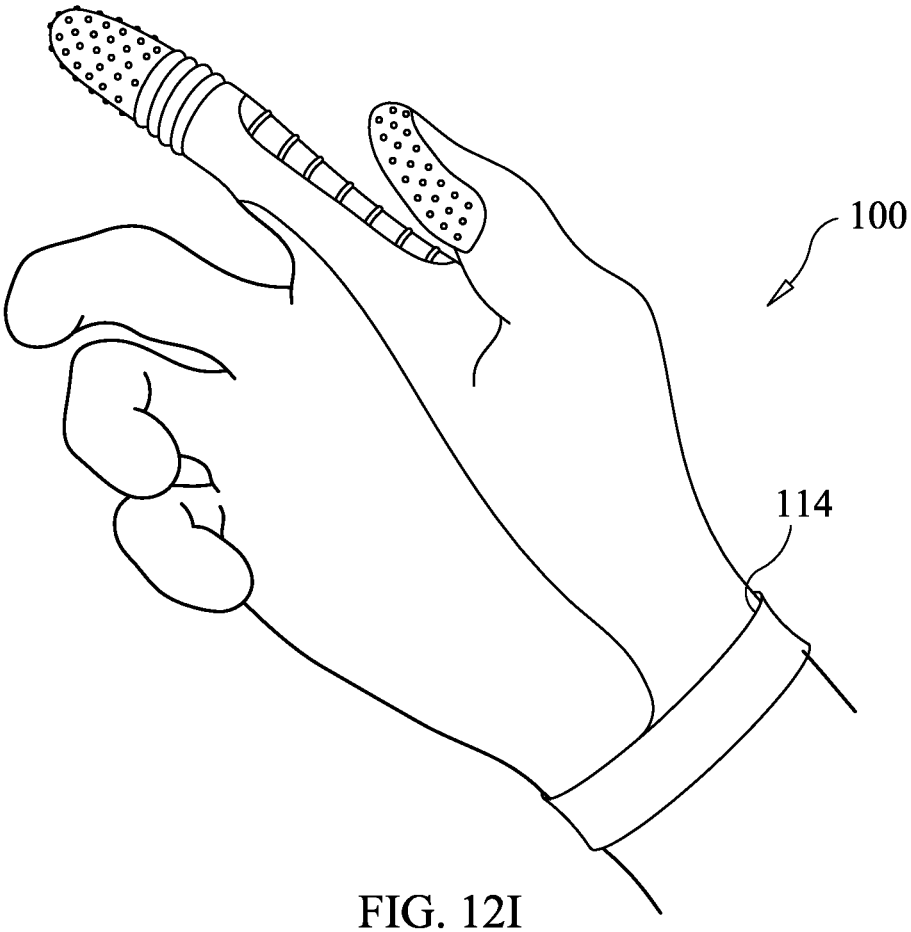
Figure 12J:
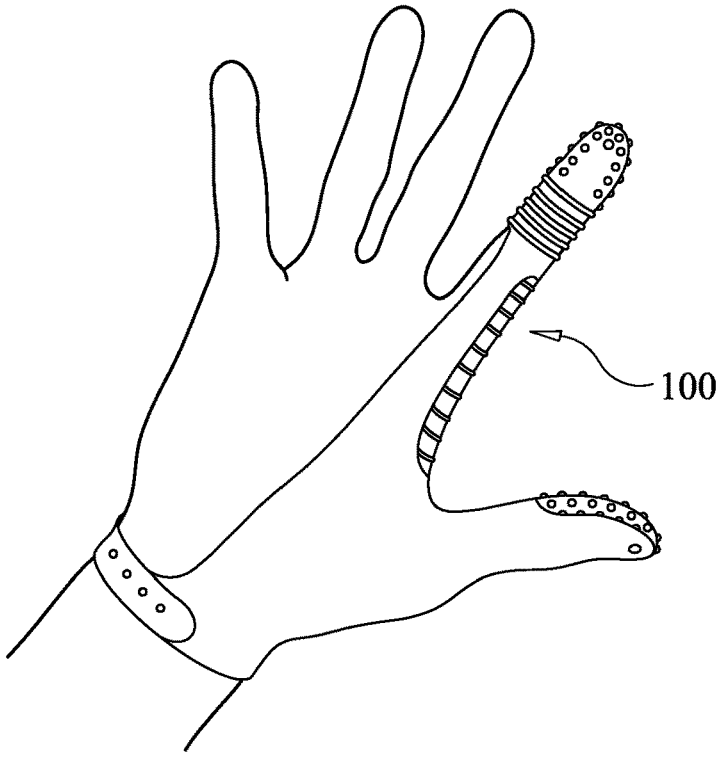
Figure 12K:
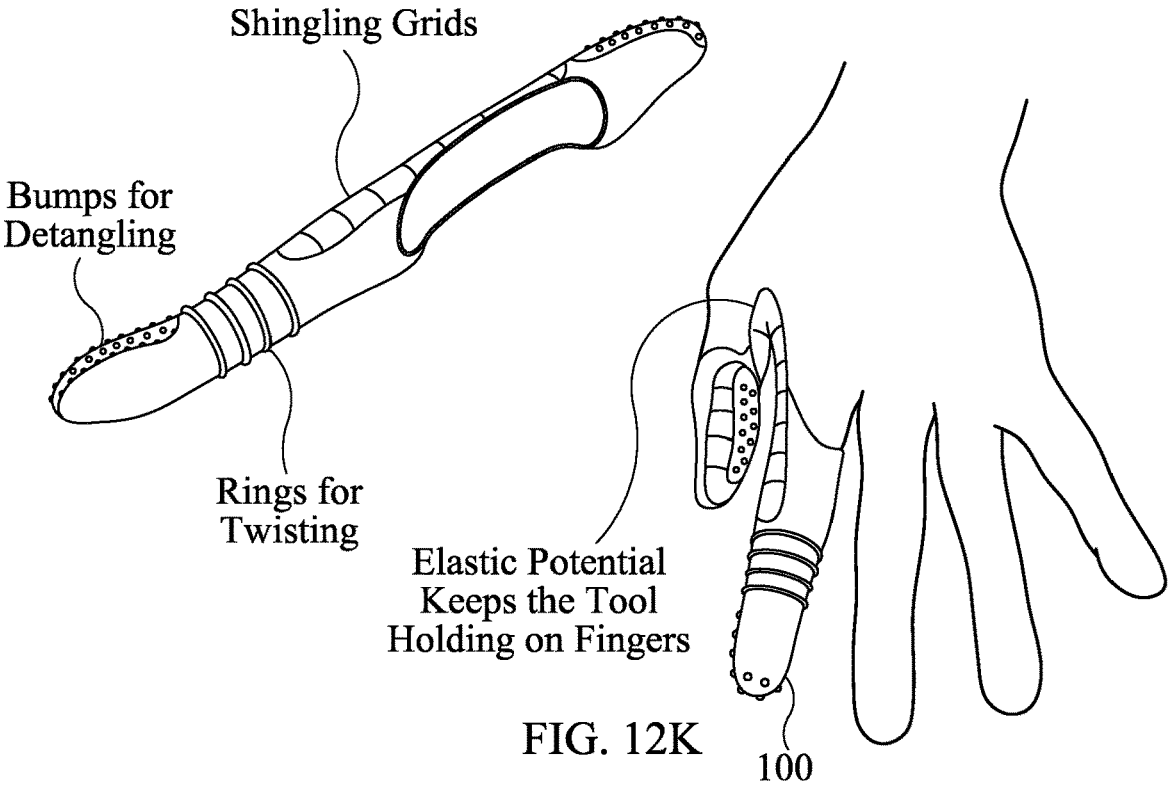

In yet another embodiment, tool 100 may comprise of one closed side 130 and one open side 124 (as shown in FIG. 11C). In yet another embodiment, tool 100 may comprise of a flexible horizontal body 102 with a handle 132 extending from the top of the upper portion 126, configured to slidably fit one or more fingers 106, 106' (FIG. 11D-11F), that may be used for shingling.

FIGS. 12A-12K each show a combination hair styling tool 100 in accordance with one or more embodiments. Finger tool 100 may comprise a flexible body 102 with one or more elongated body 104, 104', 104" that is/are tapered at a closed end 108 configured to slidably fit on a portion of one or more human fingers 106, e.g. the tips, while leaving the rest of a user's finger(s) and hands (palm and/or back of the hand) uncovered; wherein the flexible body 102 comprises a plurality of hair guiding elements 112 disposed on the tool's elongated tubular member 104; and securing means 114 positioned at the base 134 of the tool 100. In some embodiments, securing means 114 comprises anyone of Velcro®, a wrist band 136, or buckle 138, and/or any other securing means 114 that are well known and used in the arts.

METHODS OF THE INVENTION

In one embodiment, a general styling method 700 may comprise providing one or more tool(s) 100 on one or more fingers 106 while the remainder of the hand is uncovered and sliding tool(s) 100 along hair. Tool 100 may be placed on a primary finger 106, such as the index finger 106, for producing coiling and/or curling effects in the hair via the friction produced by the tool 100, and by the hair guiding elements 112, 112', and 112" guiding the hair during the sliding action. Slight load may be placed against the hair to impart greater friction, and, accordingly, tighter curls. The higher the load that is applied to the hair via tool 100, the tighter the curls, and styling effect generally. In another embodiment, additional tools 100 may be positioned on the middle finger and/or thumb of the same hand as the tool 100 on the index finger, to provide additional curling and/or coiling effects with the hair being pinched between tools 100.

As described below, tools 100, 100' may be positioned on index and thumb fingers of the same hand (as shown in FIG. 6) and may be used for MCT (defined below) methods, with optionally providing tools 100 on the middle finger, or using an optional multi-finger (e.g., 2 or 3 fingers) pad or band, as shown in FIG. 4.

In yet another embodiment, both index fingers of both hands may be fitted with tools 100 for performing braiding methods, such as French braiding. In yet a further embodiment, both index fingers and thumbs (on both hands) may be fitted with tools 100 for performing hair twisting actions, with preferably at least one tool 100 being fitted with rigid point 120 for separation hair. A user may add hair product, such as one or more of chemicals described herein as needed, prior to, or post portioning or separating hair.

Figure 7:
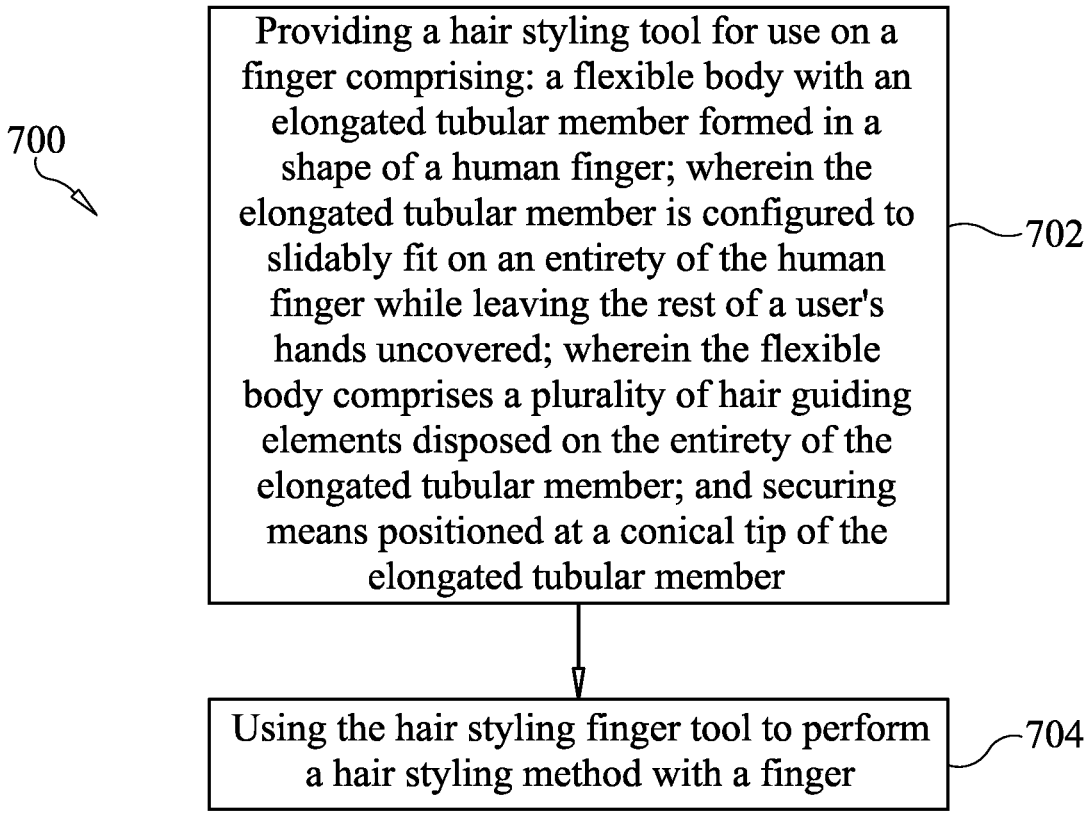
FIG. 7 shows a method for using a hair styling finger tool in accordance with one embodiment.

FIG. 7 shows a method 700 for using tool 100 to style hair in accordance with various embodiments. Traditional hair styling ("styling," as used herein, refers to the shaping of hair, as opposed to coloring) methods can easily take over three hours to complete (depending on length of hair), however method 700, which employs tool(s) 100 can reduce the amount of time it would otherwise take to coil or curl the hair by 25% to 50%. Further, method 700, which employs tool(s) 100 results in more uniform curls, and rigid point 120, if present, may be used help separate the curls or clusters of curls to get more curls, and provides for less frizz.

Method 700 may be performed by providing one or more tool(s) 100, 100' on thumb, index and middle fingers 106 of one or both hands, depending on if a user wishes to have a free hand without tools 100 to manipulate the hair and/or other tools. Tools 100 may also comprise rigid point 120. Tools 100 may comprise one or more of the various elements 112 disclosed herein depending on any additional styling effects the user wishes to impart on the hair.

In some embodiments, a method 700 of styling hair, comprises providing a hair styling finger tool 100 for use on a finger 106, wherein the hair styling finger tool 100 comprises: a hair styling tool 100 for use on a finger 106 comprising: a flexible body 102 with an elongated tubular member 104 formed in a shape of a human finger 106; wherein the elongated tubular member 104 is configured to slidably fit on an entirety of the human finger 106 while leaving the rest of a user's hands (palm and other fingers) uncovered; wherein the flexible body 102 comprises a plurality of hair guiding elements 112 disposed on the entirety of the elongated tubular member 104; and securing means 114 positioned at a conical tip 110 of the elongated tubular member 104 (collectively, step 702); and using the hair styling finger tool 100 to perform a hair styling method with at least one finger 106 (step 704).

In some embodiments, styling method 700 may comprise a coiling or curling method, which may comprise starting with clean hair, washed and conditioned, which is still damp or wet. Coiling or curling may also include, using tool 100 and/or point 120 to part hair into small rows or sections and clip the rest out of the way. Coiling or curling may also comprise using tool 100 to detangle the hair prior to coiling or curling. Optionally, a user may apply desired moisture and hold base (i.e., leave-in conditioner; curl cream; styling gel; and the like) prior to separating hair, which may improve the coil or curl inducing properties of tool 100 since the base may enable the hair to be guided more easily by the tool 100, and the base may enable the hair to cluster in the desired shape (e.g. coil or curl) more effectively since the base causes individual hair strands to clump together and form coiled or curled clusters more effectively.

Coiling or curling method may also comprise using a rigid point 120 of finger tool 100 (or simply a closed end of finger tool 100 for tools without rigid point 120) to section a piece of hair to create individual coils by dragging the sectioned hair against tool 100 (or dragged and pinched between two tools 100). Smaller sections of hair result in smaller coils, and larger sections for larger coils (using only the index finger tool 100 or index and middle finger tools 100 to pinch the hair).

In a preferable embodiment, coiling or curling is done from the scalp outward, holding the hair in between the thumb (which may be optionally and preferably fitted with tool 100) and index finger tool 100, and stretching and twirling the section of hair repeatedly, consistently moving tool(s) 100 down the hair shaft to the end of the hair shaft, creating the desired coil or curl. User may use tool(s) 100 to stretch and twirl more for a tighter curl, repeat until all the hair is completely curled or coiled, or the portion of hair desired to be coiled or curled is completely coiled or curled.

Figure 8A:
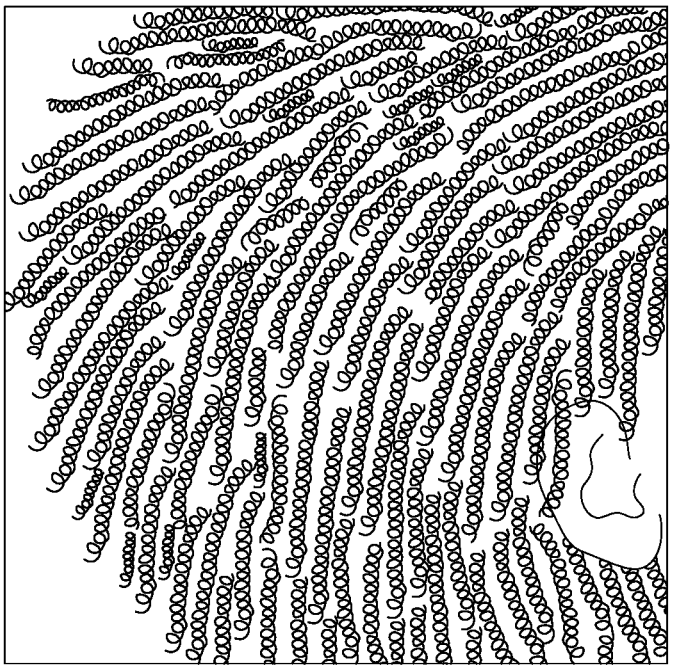
Figure 8B:
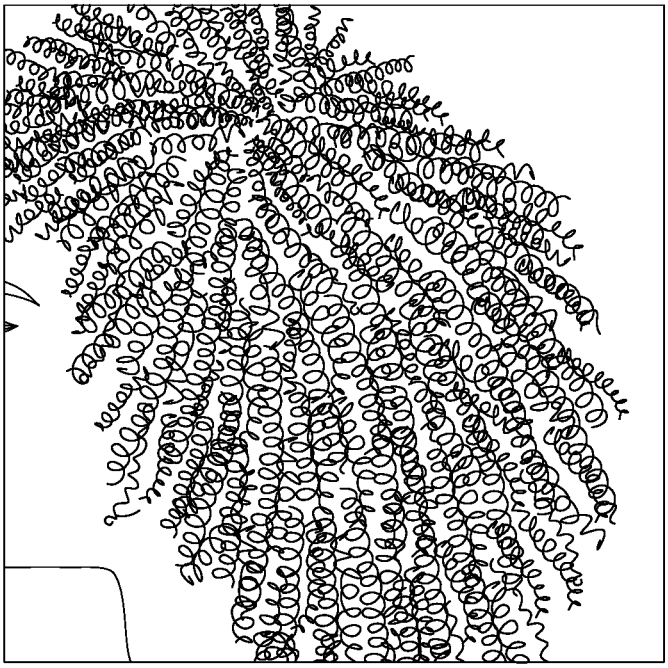
Figure 10C:
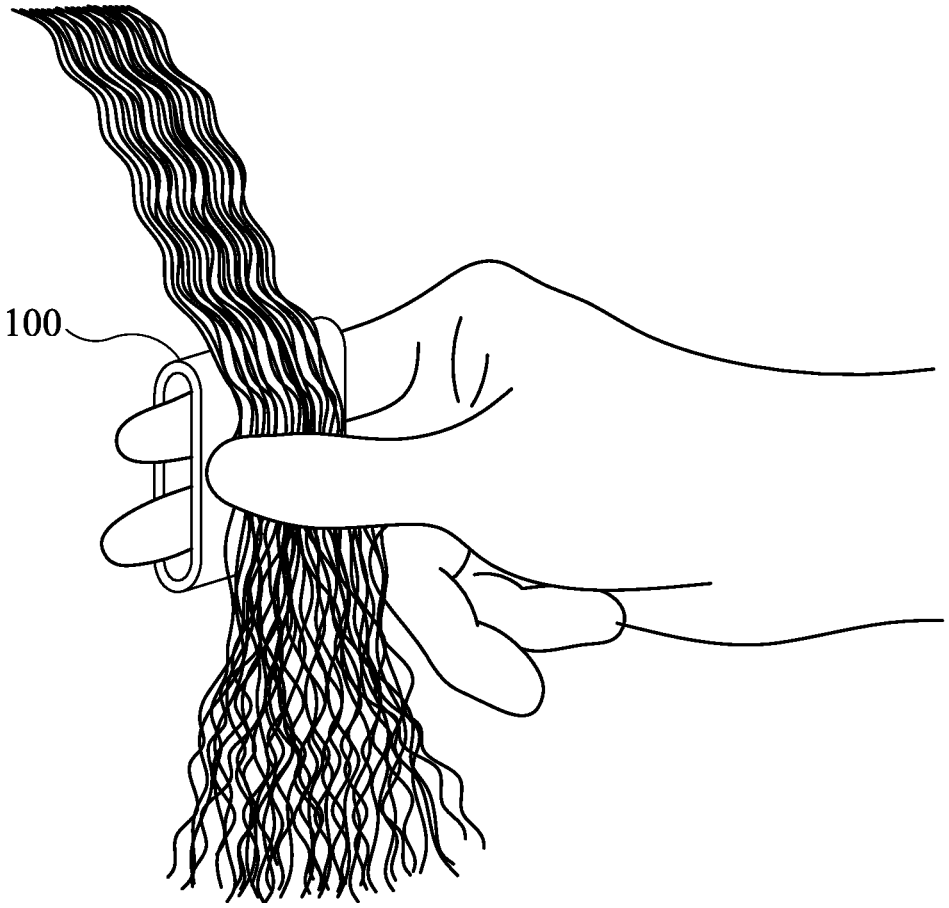
Figure 10D:
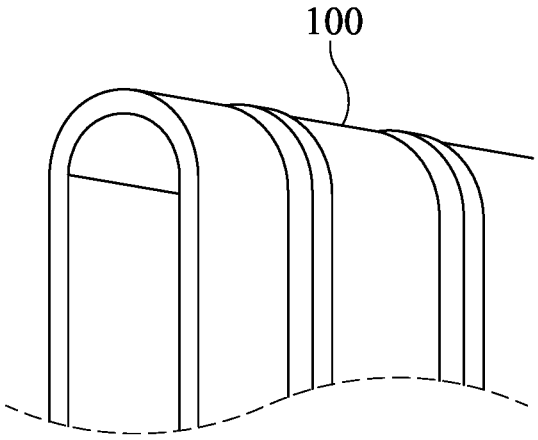
Figure 10E:
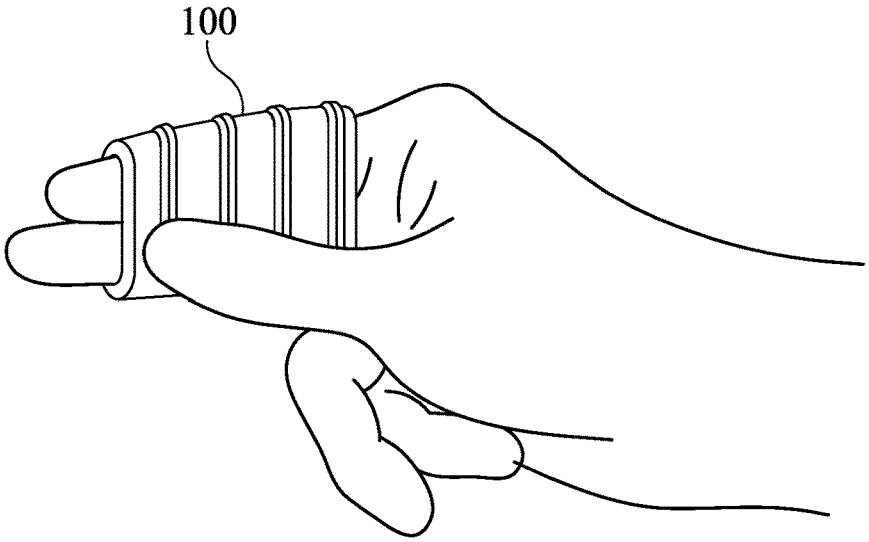
Figure 10F:
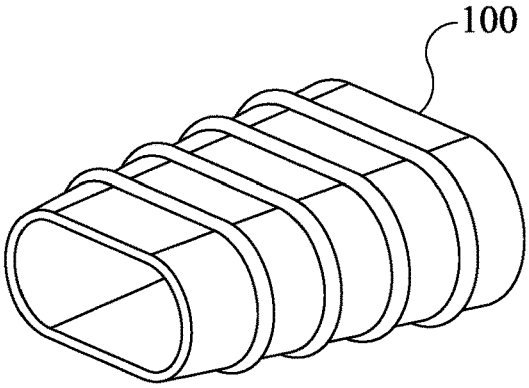
Figure 10G:
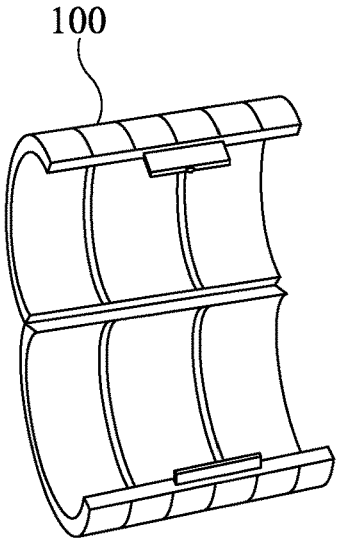

As a final optional step, user may seal hair using an oil or balm of user's choice and dry the hair using a desired drying method (e.g., blow dry, air dry, and the like). Without tool 100, the coiling or curling method could easily take over three hours to complete. However, tool 100 reduces this time by 25% through 50%. An example of the results of the coiling or curling method is shown in FIGS. 8A and 8B.

In another embodiment, method 700 may comprise performing a multistrand clustered texturing ("MCT") method. MCT method may also be referred to as "shingling," wherein small clusters of curled or coiled hair are formed in an intentionally less organized form (or if the hair is naturally curly or coily in a less organized form, then allowing the hair to retain its natural form) than the standard or intentionally more organized curling or coiling method, such as the curling/coiling method disclosed above. When performing the MCT method, the following tool 100 arrangement options may be used: (1) thumb finger tool and/or index finger tool(s) 100 (with rigid point 120 on each or both finger tools); (2) thumb with point 120 and middle finger tool 100; (3) thumb with finger tool 100 and two finger pad or band embodiment tool 100 (shown in FIG. 4) or (4) thumb finger with finger tool 100 and three finger pad or band type tool 100; or (5) any one or more combinations of exemplary arrangement options (1)-(4) referenced herein, wherein each tool 100 comprises one or more of the plurality of types of hair guiding elements 112 disclosed herein.

As it applies to the MCT method, the resistant/frictional nature of tubular member 104 of tool 100 serves to reduce the number of times a user must pass their hand to perform the MCT method. The resistance/friction induces the curls. "Shingling," as used herein, means the act of using tool(s) 100 to simultaneously curl and separate hair into clustered curls resulting in smaller and less organized clusters of curls than standard coiling or curling. If tool(s) 100 are applied to two (2) fingers that pinch the hair, then smaller clusters featuring shorter and tighter textured clusters having more retention are formed. If multiple fingers with tool(s) 100 are used on the same side (vs. opposite sides, such as when two fingers pinch hair) of the hair when stroking or passing on the hair, then longer and bigger textured clusters are formed. If a "prayer hands" method is used, wherein the user sandwiches their hair between both hands, including palms and fingers (with or without tool(s) 100), in a stroking motion, then the same result is achieved as using tool(s) 100 on the same side with a stroking motion. Therefore, an advantage of having tool(s) 100 fitted to finger(s) 106 on the same side is that the same result as traditionally using prayer hands is achieved, yet the user's other hand and other fingers are free to perform other tasks and/or remain free of contamination by the base product if it has been applied.

In some embodiments, the MCT method may comprise starting with washed and conditioned, clean damp or wet hair. The MCT method may also include using tool 100 and/or point 120 to part hair into small rows or sections and clip the rest out of the way. The MCT method may also comprise using tool 100 to detangle the hair prior (described below) to coiling or curling. Optionally, a user may apply desired moisture and hold base (e.g., leave-in conditioner; curl cream; gel; and the like) prior to separating hair, which may improve the coil or curl inducing properties of tool 100 since the base may enable the hair to be guided more easily by the tool 100, and the base may enable the hair to cluster in the desired shape (e.g., coil or curl) more effectively since the base causes individual hair strands to stick to each other and form coiled or curled clusters more effectively.

Once the hair is substantially tangle-free and separated, tool 100 (and preferably rigid point 120) may be used to section a piece of one or more hairs, wherein for finer or smaller clusters a smaller section of hair may be sectioned off, or for larger clusters, larger sections of hair may be sectioned off.

Shingling may also comprise using a tool 100 having hair guiding elements 112" (e.g., grooved) applied to a thumb and index finger (see FIGS. 2C & 2D), or thumb, index and middle fingers, or thumb and a finger-pad type tool 100 (see FIG. 4) applied to one or more fingers, capture the sectioned off hair between the tools 100, and preferably between thumb and index finger, or thumb and middle finger, tools 100 of the same hand, and move the tools 100 in a smooth outward or downward motion away from the scalp. In a further embodiment, shingling may comprise separating or dividing the hair into smaller parts thereafter and pulling or dragging the tools 100 along the divided hair away from the scalp and away from larger sections of the hair. This forms finer, frizzier, or more random or less organized clusters. If they started with smaller pieces of hair, finer and tighter clusters are formed. A user may wish to perform this optional additional step if they wish to form even finer and tighter clusters than obtained when initially performing the preceding method steps.

In the final step of forming a MCT cluster, a user would use tools 100 fitted to thumb and index fingers of the same hand to hold or pinch the divided off section of hair between the tools 100 and stretch the section of hair repeatedly moving along the section of hair in a direction away from the scalp until the end of the hair, thereby creating the desired MCT cluster. To complete the entire MCT process, the foregoing MCT steps may be repeated for the remaining portions (or all) of the hair desired to be MCT clustered or shingled. As a final optional step, user may seal hair using an oil or balm of user's choice and dry the hair using a desired drying method (e.g., blow dry, air dry, and the like). Without tool 100, the MCT method could easily take more than an hour to complete. However, tool 100 cuts down on this amount by 25% through 50%. An example of the results of the MCT method is shown in FIG. 9B.

In another embodiment, method 700 may comprise performing a braiding method. When performing the braiding method, the following tool 100 arrangement options may be used: (1) tools 100 fit to thumbs, index and middle fingers of both a user's hands (two sets of tools, one for each hand); with preferably (but optionally) rigid point 120 on any or all (preferably at least more than one) of the foregoing tools 100; and/or wherein each tool 100 comprises one or more of the plurality of types of hair guiding elements 112 disclosed herein.

As it applies to the braiding method, the resistant/frictional nature of tubular member 104 of tool 100 serves to allow a user to grip and manipulate the hair more easily and point 120 allows the user to separate the hair more easily for braiding purposes. "Braiding," as used herein, means the act of using tool(s) 100 to braid hair into various forms of braids, such as flat braids, twist-out braids, French braids (shown in FIG. 9B), and the like.

In some embodiments, the braiding method may comprise using tool 100 (preferably with bristle 112' hair guiding elements) to smooth out any knots or tangles in the hair. Then, using tool(s) 100 (preferably tools 100 fitted to thumb, index, and middle fingers on both hands) and/or point(s) 120, part hair into sections clip the rest out of the way. Thereafter, using tool(s) 100, take a desired section of hair for the braid, gather at the top of the hair (near the scalp) and divide into a number of sections or sub-sections based on the style of braid desired (e.g., three sections). Then, using tool(s) 100, crossing the sections of hair overlapping each piece. While braiding, a user may use tool(s) 100 to add hair to a particular section using tool 100 and/or point 120 and add hair to other sections or non-sectioned-off portions of hair.

In the final step of forming a braid, a user would secure the braid at its end away from the scalp with a band, roller, coil, clip, or other hair-affixing tool. As a final optional step, user may seal hair using an oil or balm of user's choice and dry the hair using a desired drying method (e.g., blow dry, air dry, and the like). Without tool 100, the braiding method could easily take over an hour to complete. However, tool 100 cuts down on this amount by 25% through 50%.

An example of the results of the braiding method is shown in FIG. 8C, and FIG. 9B (French braid). In yet another embodiment, method 700 may comprise performing a twisting method. When performing the twisting method, the following tool 100 arrangement options may be used: (1) tools 100 fit to thumbs, index and middle fingers of both a user's hands (two sets of tools, one for each hand); with preferably (but optionally) rigid point 120 on any or all (preferably at least more than one) of the foregoing tools 100; and/or wherein each tool 100 comprises one or more of the plurality of types of hair guiding elements 112 disclosed herein.

As it applies to the twisting method, the resistant/frictional nature of tubular member 104 of tool 100 serves to allow a user to grip and manipulate the hair more easily, and the rigid point 120 allows the user to separate the hair more easily for twisting purposes. "Twisting," as used herein, means the act of using tool(s) 100 to twist hair into various forms of twists.

In some embodiments, the twisting method may comprise the following steps. First, using tool 100 (preferably with a bristle 112' hair guiding element) to smooth out any knots or tangles in the hair. Then, using at least one of tool(s) 100 (preferably tools 100 fitted to thumb, index, and middle fingers on both hands) and/or tools with rigid point(s) 120, separate a part of the hair desired to be twisted (a small section for smaller or thinner twists or larger sections for larger or thicker twists). Next, starting at the roots of the hair, (preferably using tool(s) 100) separate the original section into two or three sections. Then, using both index and thumb fingers of each hand fitted with tool(s) 100, hold one of the two or three sections with each hand, then pull the hair tightly and pass one section over the other, grasping it between the index finder and middle finger of the hand with the section that has yet to be moved by the user. Still holding the hair tightly with tool(s) 100, move the second section to the other hand (and then the third section for a three-section twist) holding the second section in between the forefinger and thumb. Then, move the first section from between the middle and index fingers to between the index and thumb fingers. Lastly, pass the second section over the first section (then the third section), and then repeat the process again until the ends of the sections are reached, thereby forming a "twist." In the final step of forming a twist, a user would secure the twist at the end away from the scalp with a band, roller, coil, clip, or other hair-affixing tool. Repeat the foregoing steps until the desired number of twists is achieved, or until the entire hair has been twisted.

As a final optional step, user may seal hair using an oil or balm of user's choice and dry the hair using a desired drying method (e.g., blow dry, air dry, and the like). Without tool 100, the twisting method could easily take over two hours to complete. However, tool 100 cuts down on this amount by 25% through 50%. An example of the results of the twisting method is shown in FIG. 8D.

In yet another embodiment, method 700 may comprise performing a hairline styling method. When performing the hairline styling method, the following tool 100 arrangement options may be used: (1) tool(s) 100 fit to index and/or middle fingers of one hand (preferably both fingers, and optionally both fingers on both hands); with preferably (but optionally) rigid point 120 on any or all (preferably at least more than one) of the foregoing tools 100; and/or wherein each tool 100 comprises one or more of the plurality of types of hair guiding elements 112 disclosed herein.

As it applies to the hairline styling method, the resistant/frictional nature of the elongated tubular member 104 of tool 100 serves to allow a user to grip and manipulate the hair more easily and press it against a user's scalp and the rigid point 120 allows the user to separate the shorter and finer strands of hair (e.g., "baby hair") more easily for styling purposes. "Hairline styling," as used herein, means the act of using tool(s) 100 to style hair along the hairline of a head of hair, or in other words, the border of the head of hair as shown in FIG. 9A. A sub-set of hairline styling may be referred to as "laying edges," wherein the hair at or near the hairline or border (e.g., edge) is "laid" or pressed against a scalp in a styling manner.

In some embodiments, the hairline styling method may comprise the following steps. First, using tool 100 (preferably with a bristle 112' hair guiding element) to smooth out any knots or tangles in the hair. Optionally, then using at least one of tool(s) 100 (preferably tools 100 fitted index and middle fingers on both hands) and/or the point(s) 120, separate finer hairs near the edge of the hairline, and push the finer hairs using tool 100 (and preferably hair guiding element 112) away from the bulk of the body of hair (such as towards the face or neck), preferably starting at the roots of the finer hair. Next, dampen the finer hair using water or another moisturizing and/or hold base substance (e.g., leave-in condition, curl cream, gel, edge control paste, and the like).

Next, using finger tool(s) 100 (preferably on index and middle fingers), guide and smooth the finer hair in the desired direction and/or into a desired design or shape, such as an "S" shaped swoop design, and continue along the hairline through the sideburns, or until the location where ending the hairline styling is desired. Then, use finger tool(s) 100 to ensure the hair is lying flat and going in the direction preferred or maintaining the preferred design. Repeat the foregoing steps until the entire hairline is styled (or the portion of the hairline desiring to be styled). As a final optional step, user may seal hair using an oil or balm of user's choice (preferably non-touch or spray-on to avoid disturbing the hair shape/style via contact), and/or dry the hair using a desired drying method (e.g., blow dry, air dry, and the like). Without tool 100, the hairline styling method could easily take over half an hour to complete. However, tool 100 cuts down on this amount by 25% through 50%. An example of the results of the hairline styling method is shown in FIG. 9E.

In yet another embodiment, method 700 may comprise performing a finger detangling method. Finger detangling can be a delicate and intricate procedure. If done properly, it is preferable to do so without using combs or brushes and exclusively use finger tool(s) 100. This is especially beneficial for women who have hair that easily breaks during the detangling process, which is a common downside of using combs and brushes, as has traditionally been done. Using finger tool(s) 100 helps with length retention because the hair is at less risk of breaking when it is detangled gently using finger tool(s) 100. Some users may find that finger detangling in a dry moisturized state may be beneficial if the user's hair is stronger when dry, versus when wet (with water only or water/moisturizer), which can lead to the stretching of the hair and increased risk of hair breakage. Other users may find it beneficial to use water and/or a type of conditioner, or the like, to provide a barrier around hair strands allowing the finger tool(s) 100 to glide or slip through the hair more easily. It is also possible to incorporate finger tool(s) 100 detangling as a first part to a detangling routine prior to using a traditional comb or brush, to reduce the risk of hair breakage. Using the finger tool(s) 100 may save additional time, especially for certain types of hair (e.g., looser curl patterns may benefit more in time savings). For all hair styling methods disclosed herein, a user may find using the finger tool(s) 100 as an aid during this delicate process of detangling hair.

Additional benefits of using finger tool(s) 100 to detangle hair include: unlike combs and brushes, using finger tool(s) 100 provide a level of tactile sensitivity so a user is alerted before it is too late to remove a knot, or before hair breaks or is otherwise damaged. Thus, hair damage is minimized. For example, a user will be able to feel a knot, and thus pull apart the knot (such as from the root or end of the hair), which would otherwise be broken with a comb or brush. Further, detangling hair using finger tool(s) provides additional benefits: saving time in wash and conditioning process; provides for restyling without washing; follow detangling with finger tool(s) 100 with a comb for looser curls, or the ability to skip this step if needed; easier detangling in the shower, and/or the ability to skip final raking through the hair with a comb for final check with finger tool.

When performing the finger detangling method, while other arrangements are possible, the following tool 100 arrangement is preferred: equipping thumb, index, and middle fingers each with a tool 100 (preferably with rigid point 120 on index finger's tool 100); and/or wherein each tool 100 comprises one or more of the plurality of types of hair guiding elements 112 disclosed herein, based on a user's preference.

In some embodiments, the finger detangling method may comprise the following steps. First, using tool 100 (preferably with a point 120), section hair into a plurality of sections (preferably four or more), and clip or secure away all sections but one. Optionally, next, dampen the hair using water or another moisturizing substance (e.g., conditioner, oil, or the like, as desired). Optionally, based on user preference, start on dry hair to maintain hair that has been stretched such as by having used rollers or other hair straightening tools or methods. Further, take the remaining section that has not been secure, and separate into smaller subsections, taking all but one of the smaller subsections and securing them.

Next, on the remaining section (or sub-section) of hair, gently run finger tool(s) 100 through the hair in a preferred direction (end to root or root to end) to remove tangles and shedding hair. Repeat moving finger tool(s) 100 through hair until the section is detangled. Once the section is detangled as desired, then twist, braid, or style hair as desired, including according to any of the methods disclosed herein (e.g., MCT method, coiling, and the like) (if desired at all).

When de-tangling and/or styling complete of the subsection of hair is complete, secure away the completed subsection of hair. Part or section a new section subsection of hair (preferably using point 120) and repeat the foregoing steps on that section or subsection until completion. Repeat the foregoing steps until the entire hair (or portion thereof) is detangled and/or styled. As a final optional step, user may seal hair using an oil or balm of user's choice (preferably non-touch or spray-on to avoid disturbing the hair shape/style via contact), and/or dry the hair using a desired drying method (e.g., blow dry, air dry, and the like). Without tool 100, traditional detangling methods using combs and/or brushes could easily take over two hours to complete. However, tool 100 reduces this time by approximately 25% to 50%.

While certain elements of this invention have been shown, described and/or claimed, it is not intended to be limited to the details above, since it will be understood that various omissions, modifications, substitutions and changes in the apparatuses, forms, method, steps and system illustrated and, in its operation, can be made by those skilled in the art without departing in any way from the spirit of the present invention.

What is claimed is:

1. A hair styling finger tool kit comprising:

a plurality of hair styling finger tools, wherein each of the plurality of hair styling finger tools comprises a flexible body with an elongated tubular member formed in a shape of a human finger, the elongated tubular member is configured to slidably fit on an entirety of the human finger while leaving the rest of a user's hands uncovered, wherein the flexible body comprises a plurality of hair guiding elements disposed on the entirety of the elongated tubular member, and securing means positioned at a conical tip of the elongated tubular member;

wherein the hair guiding elements on a first of the plurality of hair styling finger tools comprises a plurality of studs;

wherein the hair guiding elements on a second of the plurality of hair styling finger tools comprises a plurality of bristles;

wherein the hair guiding elements on a third of the plurality of hair styling finger tools comprises a plurality of grooves; and at least one of the plurality of hair styling finger tools comprises an open end and a closed end, wherein the closed end comprises a rigid point or a uniformly rounded end.

2. The hair styling finger tool kit of claim 1, further comprising a set of instructions for how to use at least one of the plurality of hair styling finger tools to style hair.

* * * * *